US007665500B2

(12) United States Patent
Rossato et al.

(10) Patent No.: US 7,665,500 B2
(45) **Date of Patent: *Feb. 23, 2010**

(54) TEMPORARY WINDOW COVERING

(75) Inventors: Alejandro Rossato, Greensboro, NC (US); Amrik Singh, West Yorkshire (GB); Cliff Birch, Summerfield, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/838,708

(22) Filed: Aug. 14, 2007

(65) Prior Publication Data

US 2008/0023153 A1 Jan. 31, 2008

Related U.S. Application Data

(63) Continuation of application No. 10/698,554, filed on Oct. 31, 2003, now Pat. No. 7,255,149.

(60) Provisional application No. 60/422,553, filed on Oct. 31, 2002.

(51) Int. Cl.
*A47H 23/00* (2006.01)

(52) U.S. Cl. ..... 160/84.04; 160/368.1

(58) Field of Classification Search ..... 160/84.04, 160/84.05, 84.06, 34, 370.23, 368.1; 206/320, 206/321

See application file for complete search history.

(56) References Cited

U.S. PATENT DOCUMENTS

| | | | | |
|---|---|---|---|---|
| 1,215,985 | A | 2/1917 | Plate | 160/168.1 R |
| 1,804,811 | A | 5/1931 | Rosel | 160/168.1 R |
| 2,053,356 | A | 9/1936 | Wiener | 160/168.1 R |
| 2,129,606 | A | 9/1938 | Nisenson | 160/168.1 R |
| 2,132,991 | A | 10/1938 | Mintz | 160/168.1 R |
| 2,172,657 | A | 9/1939 | Haase | 160/173 R |
| 2,175,977 | A | 10/1939 | Stuber et al. | 160/168.1 R |
| 2,314,461 | A | 3/1943 | Schaefer | 160/173 R |
| 2,631,661 | A | 3/1953 | Nelson | 160/133 |
| 2,732,010 | A | 1/1956 | Griesser | 160/170 |
| 3,727,665 | A | 4/1973 | Debs | 160/178 C |
| 3,799,236 | A | 3/1974 | Debs | 160/178 C |
| 3,918,513 | A | 11/1975 | Englund et al. | 160/176 |
| 3,931,846 | A | 1/1976 | Zilver | 160/178 |
| 3,952,789 | A | 4/1976 | Marotto | 160/168 R |

(Continued)

*Primary Examiner*—David Purol
(74) *Attorney, Agent, or Firm*—Marshall, Gerstein & Borun LLP

(57) ABSTRACT

The invention is directed to a temporary window shade that may include an elongated cover having a top end and a bottom end, and that may be adapted to be oriented in a retracted position, an extended position, and a plurality of intermediate positions. The temporary window shade may also include a top rail that may be attached to the top end of the elongated cover, a cord having a first end that may be connected to the top rail, and a bottom rail that may be attached to the bottom end of the elongated cover. The bottom rail may have a slot disposed through a surface of the bottom rail, and the slot may be adapted to receive the cord. At least a portion of the slot may have a width less than the thickness of the cord such that the slot may engage the cord to support the weight of the bottom rail and an accumulated portion of the elongated cover when the cord is engaged by the at least a portion of the slot.

21 Claims, 28 Drawing Sheets

U.S. PATENT DOCUMENTS 4,039,020 A 8/1977 Jacobson ..... 160/178 C
4,245,688 A 1/1981 Vecchiarelli ..... 160/178 C
4,250,597 A 2/1981 Ford et al. ..... 24/132 R
4,327,797 A 5/1982 Nakajima et al. ..... 160/168 R
4,352,386 A 10/1982 Butler et al. ..... 160/178 C
4,394,996 A 7/1983 Heimberg ..... 242/222
4,476,909 A 10/1984 Anderle et al. ..... 160/178 C
4,487,243 A 12/1984 Debs ..... 160/168 R
4,488,588 A 12/1984 McClure ..... 160/178 C
4,647,488 A 3/1987 Schnebly et al. ..... 428/116
4,649,982 A 3/1987 Baumann et al. ..... 160/172
4,722,383 A 2/1988 Kross ..... 160/178 C
4,932,710 A 6/1990 Chen ..... 296/97.3
4,932,711 A 6/1990 Goebel ..... 296/97.7
4,945,970 A 8/1990 Marocco ..... 160/178.2
5,143,135 A 9/1992 Kuhar ..... 160/107
5,156,196 A 10/1992 Corey et al. ..... 160/178.2
5,158,127 A 10/1992 Schumacher ..... 160/84.1
5,199,230 A 4/1993 Gehman ..... 52/66
5,230,122 A 7/1993 Robinson ..... 16/87.4 R
5,285,838 A 2/1994 Rapp et al. ..... 160/168.1
5,297,608 A 3/1994 Rap et al. ..... 160/177
5,314,226 A * 5/1994 Tovar ..... 296/97.7
5,316,066 A 5/1994 Rapp et al. ..... 160/178.2
5,538,066 A 7/1996 Liu ..... 160/173
5,623,982 A 4/1997 Okazaki ..... 160/178.2
5,791,022 A 8/1998 Bohman ..... 24/130
5,799,715 A 9/1998 Biro et al. ..... 160/170 R
6,131,640 A 10/2000 Judkins ..... 160/168.1 R
6,338,378 B1 1/2002 Kold ..... 160/279
6,443,207 B1 9/2002 Cheng et al. ..... 160/84.04
6,786,268 B2 9/2004 Corey et al. ..... 160/84.05
6,793,073 B2 9/2004 Tu ..... 206/320
6,845,801 B2 1/2005 Hsu ..... 160/84.04
7,255,149 B2 8/2007 Rossato et al. ..... 160/84.04

* cited by examiner

TEMPORARY WINDOW COVERING

REFERENCE TO RELATED APPLICATIONS

This application is a continuation of U.S. Ser. No. 10/698,554 filed in the Patent Office on Oct. 31, 2003, now U.S. Pat. No. 7,255,149, which claims priority from Provisional Application Ser. No. 60/422,553, filed on Oct. 31, 2002, now expired, which are expressly incorporated by reference herein.

BACKGROUND

The present invention is directed to window coverings, and more particularly to a temporary window covering that may be mounted proximate a window or other opening, and may be raised and lowered to selectively allow the passage of a desired amount of light.

Various temporary coverings have been previously described. For example, U.S. Pat. No. 5,158,127 to Schumacher discloses a temporary covering for a window or the like, including an elongated paper-like sheet having equidistant parallel pleats defined by creases extending across the sheet. An adhesive fastening strip is located at the top end of the sheet for fastening the sheet to a window, window frame, or the like. When mounted to a window or window frame, the temporary window covering extends downwardly to a selective variable length, while maintaining a pleated appearance.

U.S. Pat. No. 6,443,207 to Cheng et al. discloses a method of controlling the vertical height of a window shade having a top and bottom. The method includes providing a shade upper support structure at or proximate the shade top, providing at least one substantially vertically elongated shade support line extending downwardly from the upper support structure, and providing a shade lower support structure at or proximate the shade bottom. The method further includes elevating or lowering the shade lower support structure relative to one or more support lines, and securing the shade lower support structure to the line or lines at a selected height position relative to the line length above the lower support structure, whereby the height of the shade bottom can be quickly manually adjusted by adjustment of the height of the shade lower support structure and securing the lower support structure in the adjusted position.

SUMMARY OF THE INVENTION

In one aspect, the invention is directed to a temporary window covering that may have a pleated cover and a bottom rail. The pleated cover may be formed from a sheet of material having a plurality of horizontal creases extending across the width of the sheet thereby defining a plurality of pleats, and the pleated cover may be adapted to be oriented in a retracted position wherein each of the pleats is substantially horizontally aligned and in contact with the adjacent pleats, an extended position wherein each of the pleats is substantially vertical and substantially vertically aligned with the other pleats, and a plurality of intermediate positions wherein at least some of the pleats are oriented between the pleats' retracted positions and the pleats' extended positions. The bottom rail may be attached to a bottommost pleat of the pleated cover, and the bottom rail may be adapted to be configured in a first position wherein the bottom rail encircles the pleated cover to prevent the covering from being extended to the extended position, and a second position wherein the bottom rail does not encircle the pleated cover such that the pleated cover may be extend to the extended position and to intermediate positions.

In another aspect, the invention is directed to a temporary window covering that may have an elongated cover and a bottom rail. The elongated cover may have a top end and a bottom end, and may be adapted to be oriented in a retracted position, an extended position, and a plurality of intermediate positions. The bottom rail may be attached to the bottom end of the elongated cover, and may be adapted to be configured in a first position wherein the bottom rail encircles the elongated cover to prevent the elongated cover from being extended to the extended position, and a second position wherein the bottom rail does not encircle the elongated cover such that the elongated cover may be extend to the extended position and to intermediate positions.

In a further aspect, the invention is directed to a temporary window shade that may include an elongated cover having a top end and a bottom end, and that may be adapted to be oriented in a retracted position, an extended position, and a plurality of intermediate positions. The temporary window shade may also include a top rail that may be attached to the top end of the elongated cover, a cord having a first end that may be connected to the top rail, and a bottom rail that may be attached to the bottom end of the elongated cover. The bottom rail may have a slot disposed through a surface of the bottom rail, and the slot may be adapted to receive the cord. At least a portion of the slot may have a width less than the thickness of the cord such that the slot may engage the cord to support the weight of the bottom rail and an accumulated portion of the elongated cover when the cord is engaged by the at least a portion of the slot.

In yet another aspect, the invention is directed to a temporary window shade that may include a pleated cover that may be formed from a sheet of material having a plurality of horizontal creases extending across the width of the sheet thereby defining a plurality of pleats, with each pleat having a hole therethrough. The pleated cover may be adapted to be oriented in a retracted position wherein each of the pleats is substantially horizontally aligned and in contact with the adjacent pleats, an extended position wherein each of the pleats is substantially vertical and substantially vertically aligned with the other pleats, and a plurality of intermediate positions wherein at least some of the pleats are oriented between the pleats' retracted positions and the pleats' extended positions. The temporary window shade may also include a top rail that may be attached to a topmost pleat of the pleated cover, a cord having a first end that may be connected to the top rail, with the cord being threaded through the holes of the pleats of the pleated cover, and a bottom rail that may be attached to a bottommost pleat of the pleated cover. The bottom rail may have a slot disposed through a surface of the bottom rail, and the slot may be adapted to receive the cord. At least a portion of the slot may have a width less than the thickness of the cord such that the slot may engage the cord to support the weight of the bottom rail and an accumulated portion of the elongated cover when the cord is engaged by the at least a portion of the slot.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of a patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this provisional patent application, which would still fall within the scope of the claims defining the invention.

It should also be understood that, unless a term is expressly defined in this provisional patent application using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this provisional patent application.

Figure 1:
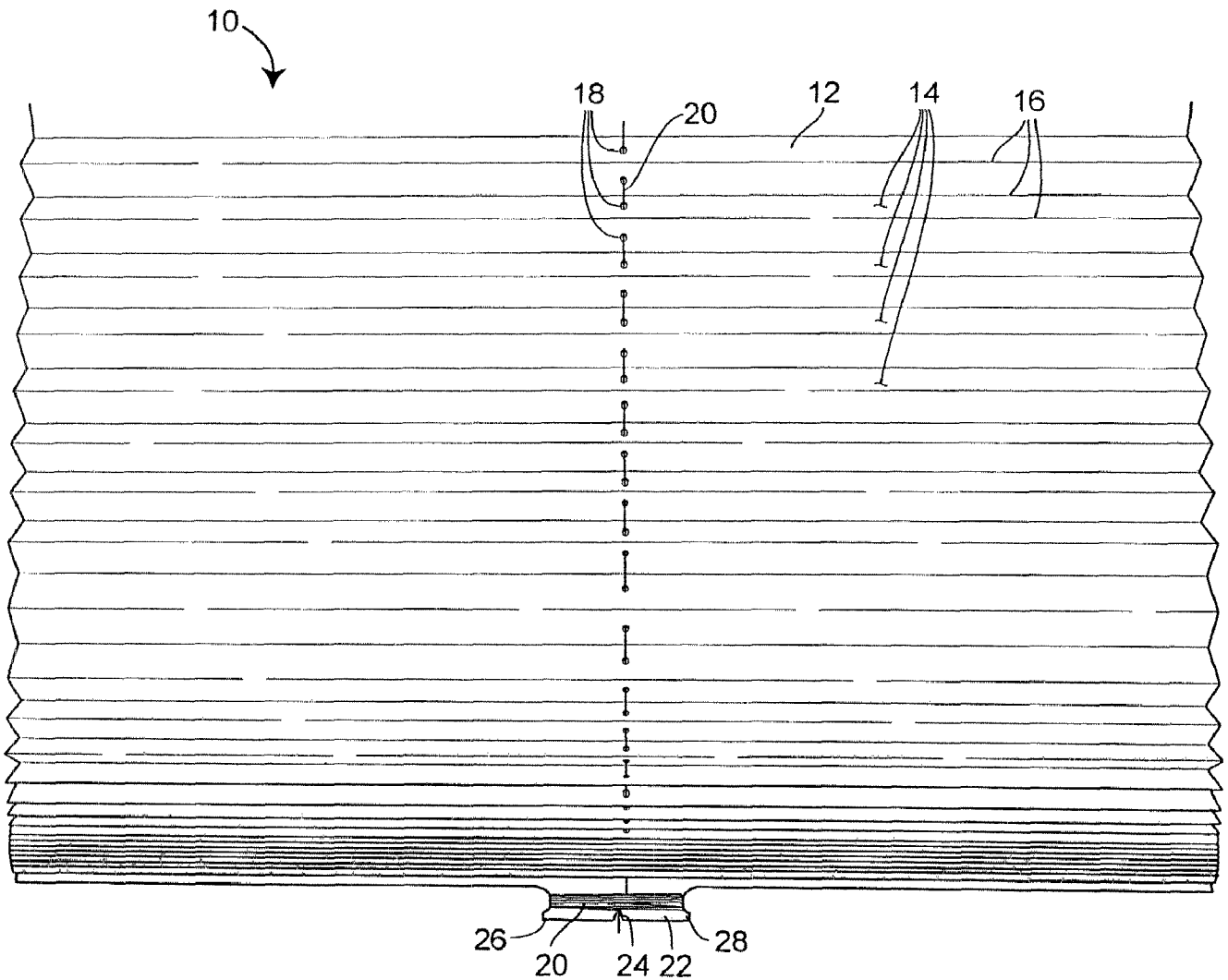
FIG. 1 is a front view of an embodiment of a temporary window covering.

FIG. 1 illustrates one possible embodiment of a temporary window covering 10 in accordance with the invention. In the illustrated embodiment, the window covering 10 includes a pleated cover 12 having a plurality of horizontal pleats 14 defined by a plurality of horizontal creases 16 extending across the entire width of the pleated cover 12. Configured in this way, the pleated cover 12 may assume a completely retracted position wherein each of the pleats 14 is substantially horizontal and in contact with the adjacent pleats 14, or a completely extended position wherein each of the pleats 14 is substantially vertical and substantially vertically aligned with the other pleats 14. Moreover, the pleated cover 12 may assume intermediate positions wherein some or all of the pleats 14 are oriented between their compressed positions and their fully extended positions. The pleated cover 12 may be formed from a sheet of paper, vinyl, textile or other suitable material known to those skilled in the art. Moreover, the material may also have a character and thickness making the pleated cover 12 cuttable so that the window covering 10 may be sized by the consumer to fit the covered opening.

Each of the pleats 14 of the pleated cover 12 includes a hole 18 passing therethrough approximately equidistant from the sides of the pleated cover 12. The holes 18 through the pleats 14 are positioned between the crease 16 defining the corresponding pleats 14 by a consistent distance such that the holes 18 are substantially vertically aligned when the pleated cover 12 is in the fully retracted position. A cord 20 passes through the holes 18, and has its upper end attached at the top of the pleated cover 12 (not shown) and its bottom end extending beyond the bottom end of the pleated cover 12. At the bottom end of the pleated cover 12, a handle 22 may be connected to the bottom end of the pleated cover 12 and disposed proximate the mid-way point between the side edges of the pleated cover 12. The handle 22 includes an opening 24 through which the bottom end of the cord 20 passes out of the window covering 10. The handle 22 further includes outwardly extending edges, each of which extends toward a side edge of the window covering 10.

The window covering 10 may be installed to cover an opening by attaching the top end of the pleated cover 12 (not shown) proximate the top of the opening. The top end of the pleated cover 12 may be attached directly to the frame, casement, wall or other structure that at least partially defines the upper boundary of the opening to be covered by the window covering 10. The attachment of the top end of the pleated cover may be achieved by an adhesive or an adhesive strip between the top end of the pleated cover 12 and the surface to which the window covering 10 is attached, or by any other temporary fastener or attachment mechanism in a manner that will be readily apparent to those skilled in the art.

Once installed, the window covering 10 may be adjusted to any desired position by moving the handle 22 up or down along the cord 20 with the bottom end of the cord 20 passing through the opening 24. When the handle 22 is set to the desired position, and excess cord 20 may be pulled through the opening 24 until any slack in the cord 20 is taken up. Once the excess cord 20 is pulled through the opening 24, the extra cord 20 may be wrapped around the handle 22, with the free end of the cord 20 tucked into the wrapped portion of the cord 20 to prevent the cord 20 for unwinding from the handle 22. Once wrapped around the handle 22, the outwardly extending edges 26 and 28 of the handle 22 prevent the wrapped portion of the cord 20 from sliding downwardly and off the handle 22. When the user wishes to adjust the pleated cover 12, the excess portion of the cord 20 may be unwrapped from the handle 22 so that the bottom of the pleated cover 12 and the handle 22 are free to move up and down along the cord 20 with the cord 20 passing through the opening 24. Once the pleated cover 12 is repositioned, the excess portion of the cord 20 is again wrapped around the handle 22 with the end of the cord 20 tucked into the portion of the cord 20 wrapped around the handle 22 to retain the pleated cover 12 in the desired position.

Figure 2:
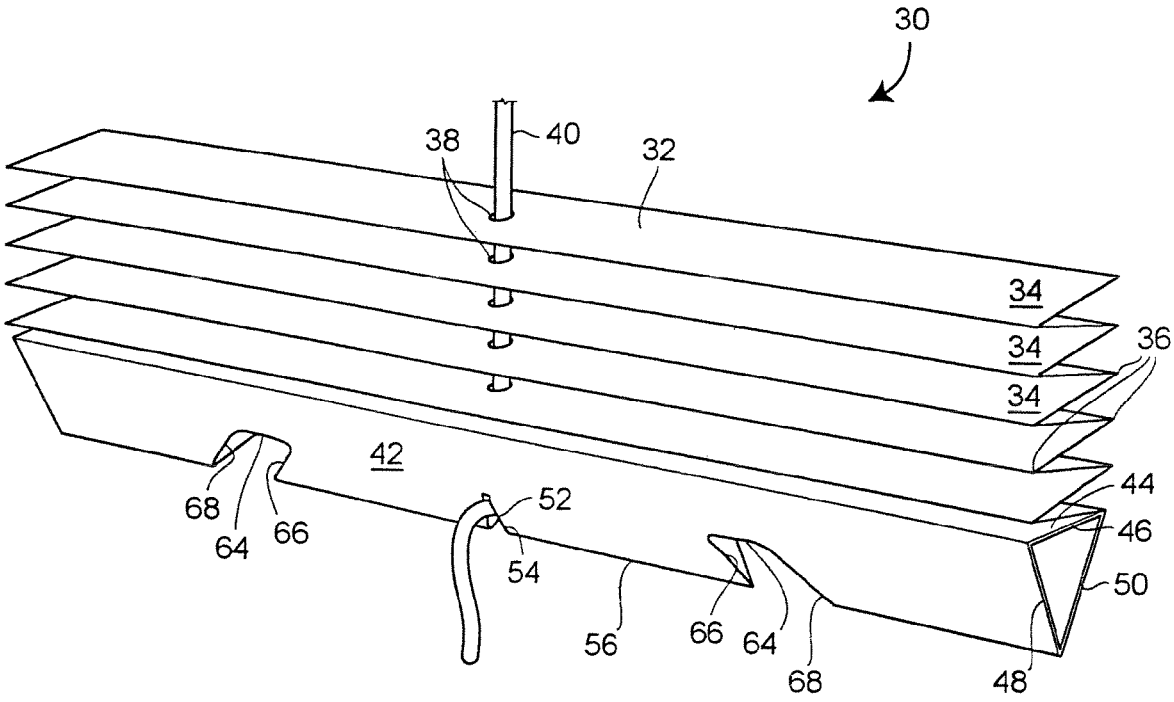
FIG. 2 is a front perspective view of an alternative embodiment of a temporary window covering.

Referring now to FIG. 2, another embodiment of a temporary window covering 30 in accordance with the invention is illustrated. As with the previous embodiment, the window covering 30 includes a pleated cover 32 subdivided into a plurality of pleats 34 defined by horizontal creases 36 extending across the entire width of the pleated cover 32. Holes 38 in the pleats 34 have a cord 40 passing therethrough from the top of the pleated cover 32 through the bottom of the pleated cover 32, with the holes 38 being substantially vertically aligned. As shown in FIG. 2, the window covering 30 further includes a bottom rail 42, which may have a triangular cross section, attached to a bottommost pleat 44. As with the pleated cover 32, the material from which the bottom rail 42 is fabricated, which may be cardboard, plastic or other semi-rigid but bendable material, may have a character and thickness making the bottom rail 42 cuttable so the window covering 30 may accommodate openings of varying sizes.

Figure 3:
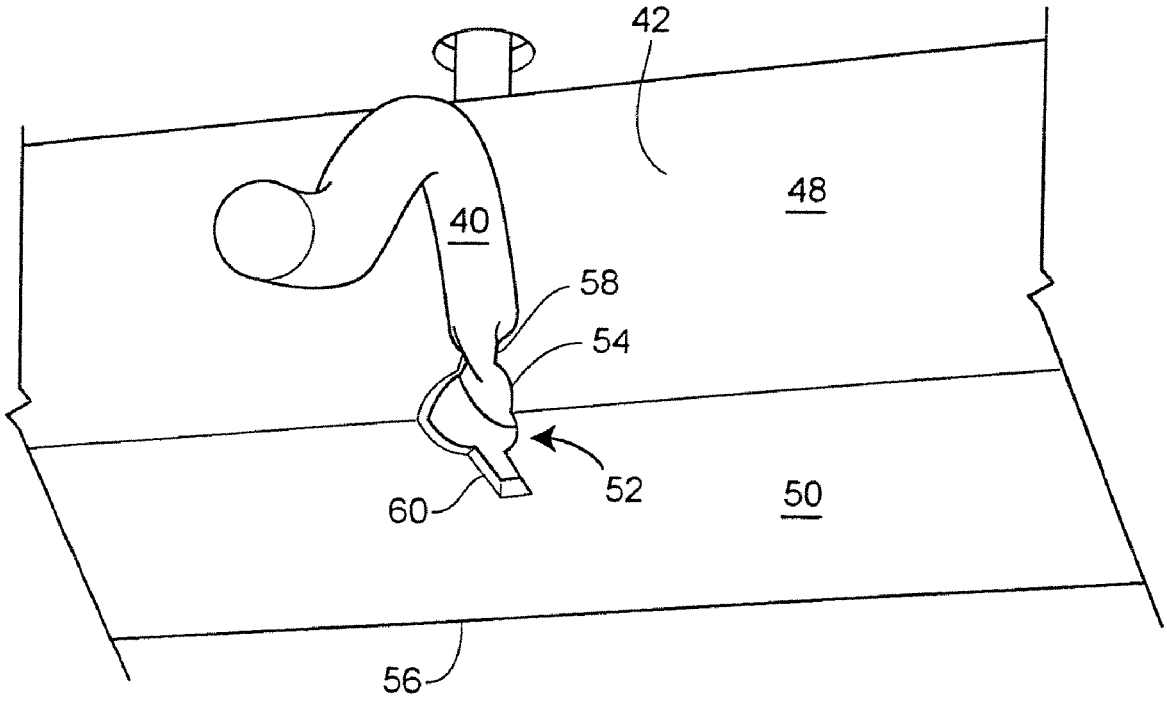
FIG. 3 is a bottom perspective view of a portion of the bottom rail of the temporary window covering of FIG. 2.

In the embodiment shown in FIG. 2, the bottom rail 42 has a triangular cross section defined by a top side 46, a front side 48, and a rear side 50. The top side 46 of the bottom rail 42 includes a hole (not shown), and the front side 48 and rear side 50 have a slot 52 disposed approximate their adjoining edge through which the cord 40 passes. As shown in FIG. 3, the slot 52 includes a rounded center opening 54 disposed at the bottom edge 56 of the bottom rail 42 and narrow portions 58 and 60 of the slot 52 in the front side 48 and rear side 50, respectively. The rounded center opening 54 of the slot 52 is dimensioned sufficiently large so that the cord 40 may pass freely through the rounded center opening 54 when the cord 40 is disposed therein. The narrow portions 58 and 60 of the slot 52 are dimensioned such that the cord 40 is engaged by the narrow portions 58 or 60 when the cord 40 is disposed therein to prevent the cord 40 from sliding within the narrow portions 58 and 60 under the weight of the bottom rail 42 and accumulated portion of the pleated cover 32 supported by the cord 40 and slot 52.

In order to adjust the window covering 30, the free end of the cord 40 is disposed within the rounded center opening 54 of the slot 52 so that the bottom rail 42 moves along the cord 40 as the bottom rail 42 is repositioned. Once the bottom rail 42 is in the desired position, the portion of the cord 40 disposed in the slot 52 is pulled from the rounded center opening 54 to one of the narrow portions 58 or 60 wherein the cord 40 in engaged by the narrow portion 58 or 60 to retain the bottom rail 42 in the desired position. When it is desired to reposition the bottom rail 42, the engaged portion of the cord 40 is moved from the narrow portion 58 or 60 to the rounded center opening 54 so that the bottom rail 42 may again move along the cord 40.

Returning to FIG. 2, once the bottom rail 42 is moved to a desired position, and the portion of the cord 40 disposed within the slot 52 is disposed within one of the narrow portions 58 or 60, the free end of the cord 40 is exposed and dangling from the bottom rail 42. For safety and aesthetic reasons, it may be desirable to wind up or tie off the excess cord 40. As shown in FIG. 2, the bottom rail 42 may include notches 62 and 64 cut out of the front side 48 and rear side 50 on opposite sides of the slot 52. The notches 62 and 64 are cut out of the front side 48 and rear side 50 proximate the bottom edge 56 of the bottom rail 42 such that portions of the bottom edge 56 are removed at the bottom of the notches 62 and 64. The notches 62 and 64 may each include an inner edge disposed on the side of the notch 62 or 64 proximate the slot 52 that is angled towards the slot 52 as the inner edge 66 moves upwardly from the bottom edge 56 of the bottom rail 42. The notches 62 and 64 may also include outer edges 68 disposed on the outward sides of the notches 62 and 64, and which may also be angled inwardly toward the slot 52 as the outer edges 68 move upwardly from the bottom edge 56 of the bottom rail 42.

Figure 4:
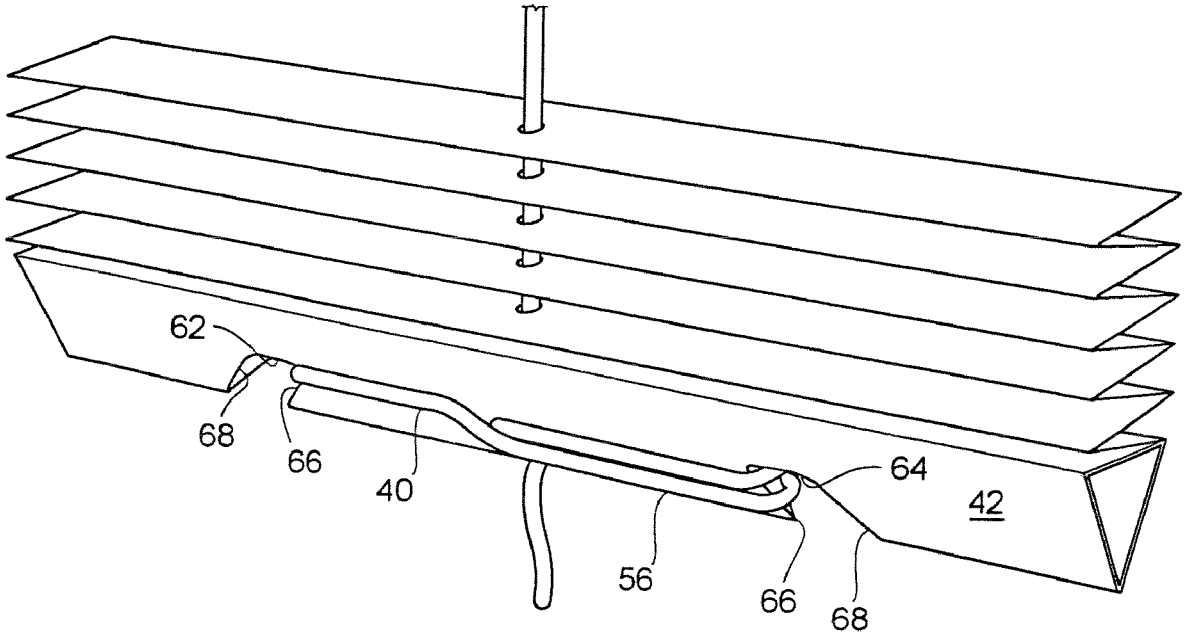
FIG. 4 is a front perspective view of the temporary window covering of FIG. 2 with the cord wrapped on the bottom rail.
Figure 5:
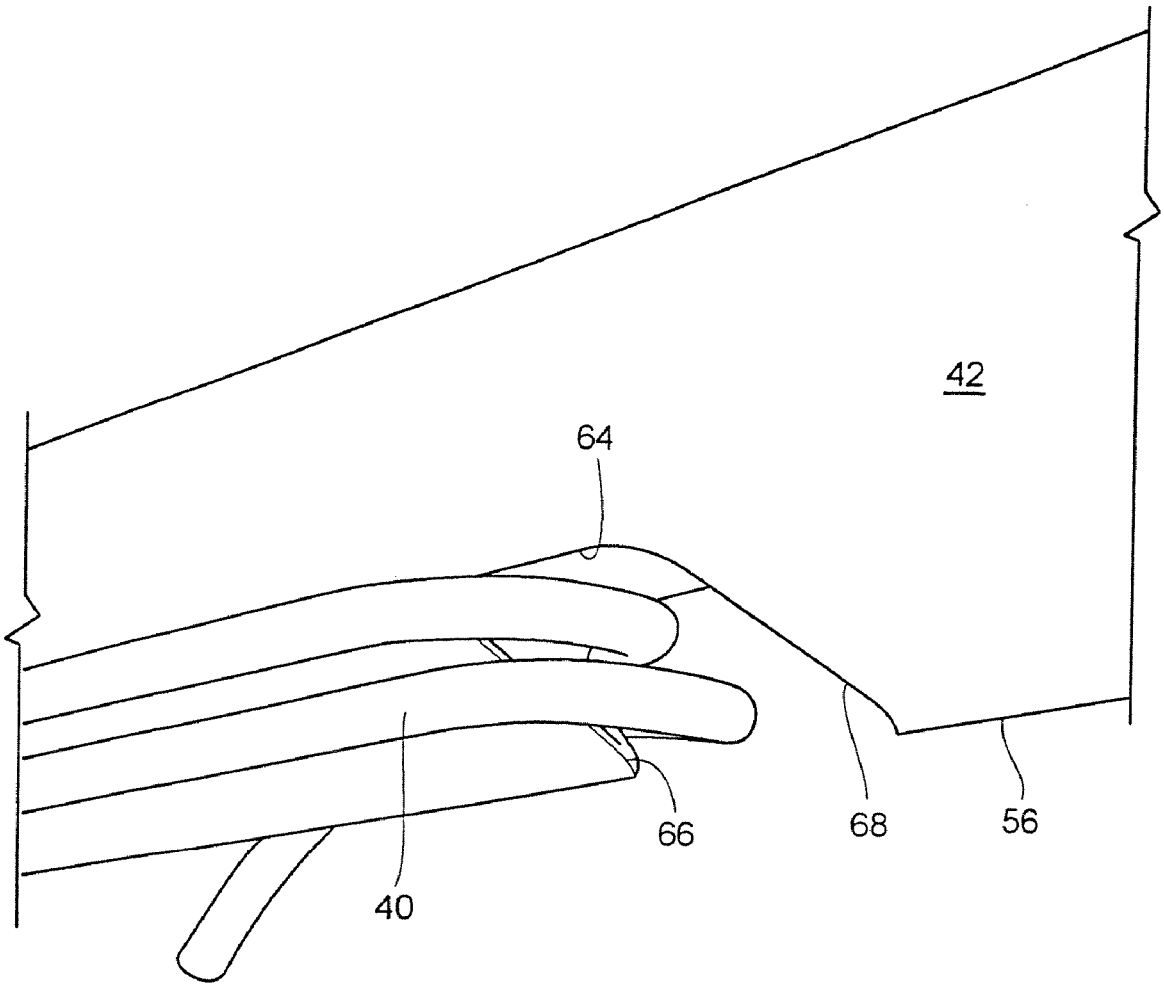
FIG. 5 is a front perspective view of a portion of the bottom rail of the temporary window covering of FIG. 2.
Figure 6:
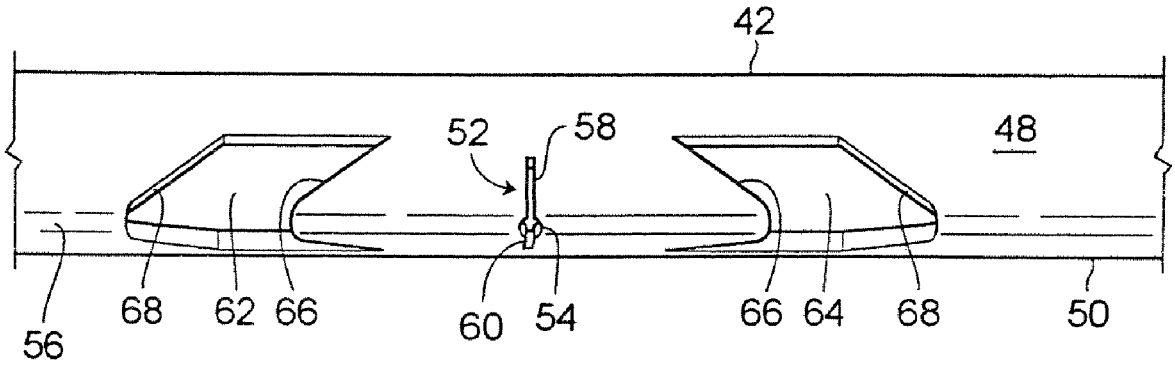
FIG. 6 is a bottom perspective view of a portion of the bottom rail of the temporary window covering of FIG. 2.
Figure 7:
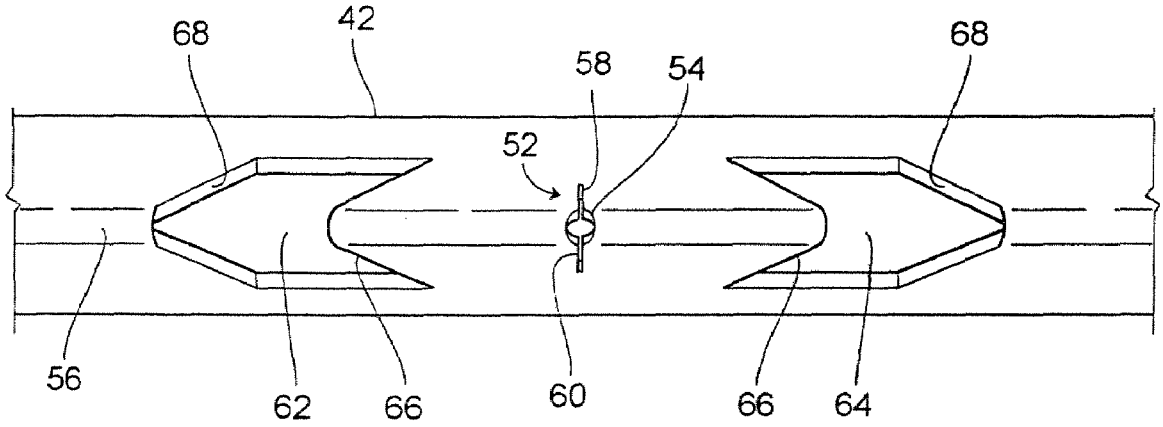
FIG. 7 is another bottom perspective view of a portion of the bottom rail of the temporary window covering of FIG. 2.

As shown in FIGS. 4 and 5, the excess portion of the cord 40 may be wrapped around the notches 62 and 64 and the portions of the front side 48 and rear side 50 therebetween. As the excess portion of the cord 40 is wrapped around the notches 62 and 64 and pulled taught, the outer edges 68 of the notches 62 and 64 force the cord 40 inwardly toward the inner edges 66 of the notches 62 and 64. At the same time, the cord 40 slides upwardly and inwardly along the inner edges 66 toward the top of the notches 62 and 64. Once the cord 40 is wrapped around the notches 62 and 64, and the free end of the cord 40 is tucked into the wrapped portion of the cord 40, the inward angling of the inner edges 66 prevents the wrapped portion of the cord 40 from sliding downwardly and out of the notches 62 and 64, thereby preventing the wrapped portion of the cord 40 from unwinding. When it is desired to reposition the bottom rail 42 of the window covering 30, the free end of the cord 40 is untucked from the wrapped portion of the cord 40, and the cord 40 is unwound from the notches 62 and 64 so that the cord 40 may be moved from the narrow portion 58 or 60 of the slot 52 to the rounded center opening 54 to allow the bottom rail 42 to move along the cord 40. The design of the bottom rail 42 is further illustrated in FIGS. 6 and 7 wherein the same parts of the bottom rail 42 are designated by the same reference numerals.

Figure 8:
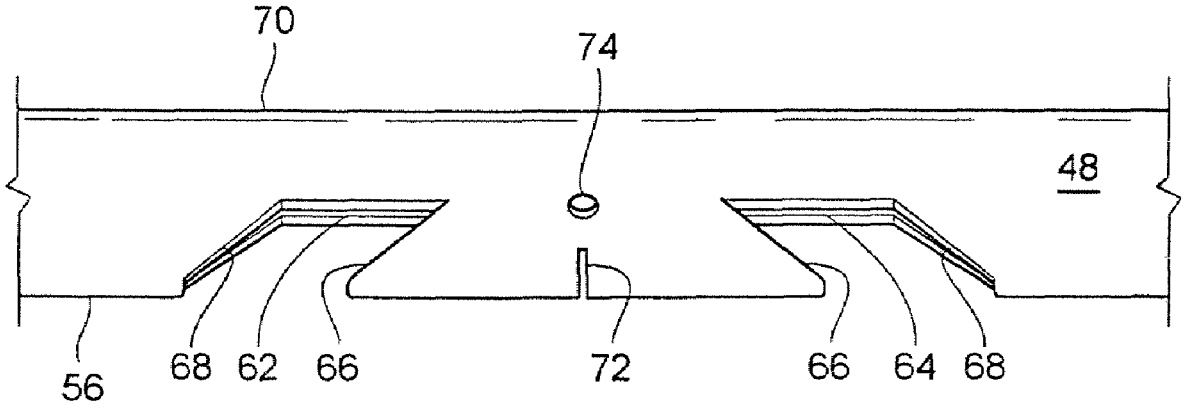
FIG. 8 is a front perspective view of an alternative embodiment of the bottom rail of the temporary window covering of FIG. 2.

FIG. 8 illustrates an alternative embodiment of a bottom rail 70 in accordance with the invention, wherein similar parts are designed by the same reference numerals. Bottom rail 70 includes a slot 72 having a substantial uniform width through the front side 48 and rear side 50 (not shown) proximate the bottom edge 56. The slot 72 may be dimensioned similar to the narrow portions 58 and 60 of the slot 52 so that the slot 72 engages the cord 40 to retain the cord 40 against the accumulated weight of the stacked portion of the pleated cover 12 and the bottom rail 70 supported thereby. The bottom rail 70 further includes a separate hole 74 through the front side 48 through which the cord 40 passes such that the free end of the cord 40 is disposed external to the bottom rail 70. The hole 74 is dimensioned similar to the rounded center opening 54 of the slot 52 so that the bottom rail 70 may move along the cord 40 as the cord 40 passes through the hole 74. The bottom rail 70 may be repositioned by disengaging the cord 40 from the slot 72 and moving the bottom rail 70 along the cord 40 as the cord 40 passes through the hole 74. Once the bottom rail 70 is positioned as desired, the portion of the cord 40 proximate the hole 74 is pulled through the slot 72 so that the slot 72 engages the cord 40 to retain the bottom rail 70 in the desired position. The excess portion of the cord 40 is wrapped around the notches 62 and 64 and the portions of the front side 48 and the rear side 50 therebetween in the manner previously described with respect to bottom rail 42. When it is again desired to move the bottom rail 70, the excess portion of the cord 40 is unwound from the notches 62 and 64 and the cord 40 is pulled out of the slot 72 to once again allow the bottom rail 70 to move along the cord 40 as the cord 40 passes through hole 74.

Figure 9:
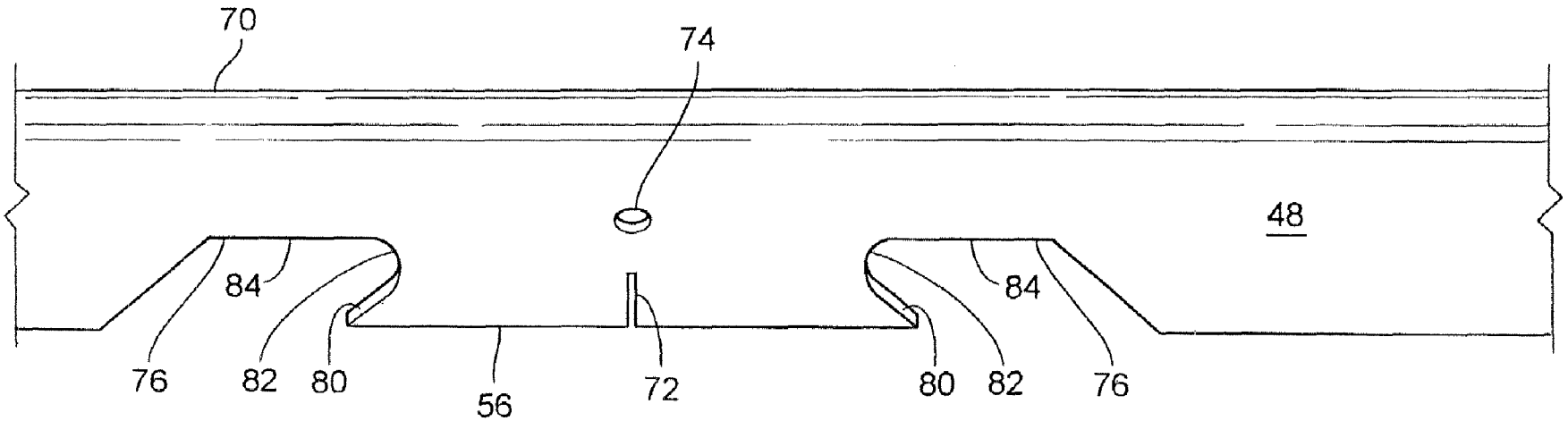
FIG. 9 is a front perspective view of another alternative embodiment of the bottom rail of the temporary window covering of FIG. 2.
Figure 10:
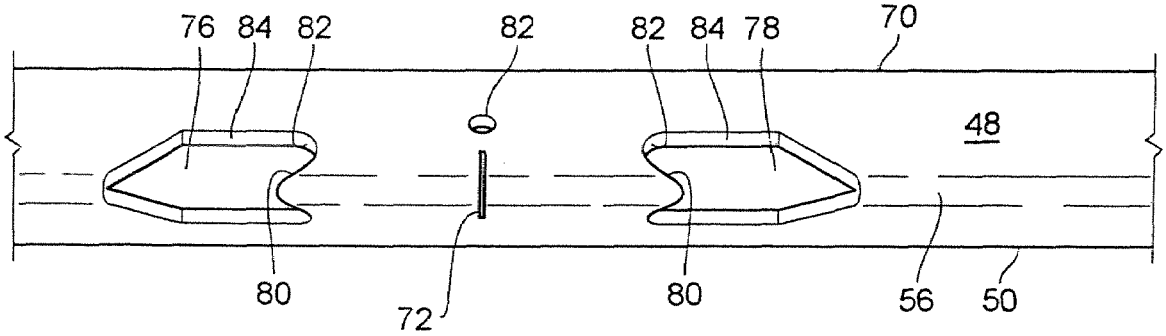
FIG. 10 is a bottom perspective view of the bottom rail of FIG. 9.

FIGS. 9 and 10 illustrate an alternative embodiment of the bottom rail 70 wherein notches 76 and 78 include rounded inner edges 80, including a radiused portion 82 at the intersection of the inner edges 80 and the upper edges 84 of the notches 76 and 78.

Figure 11:
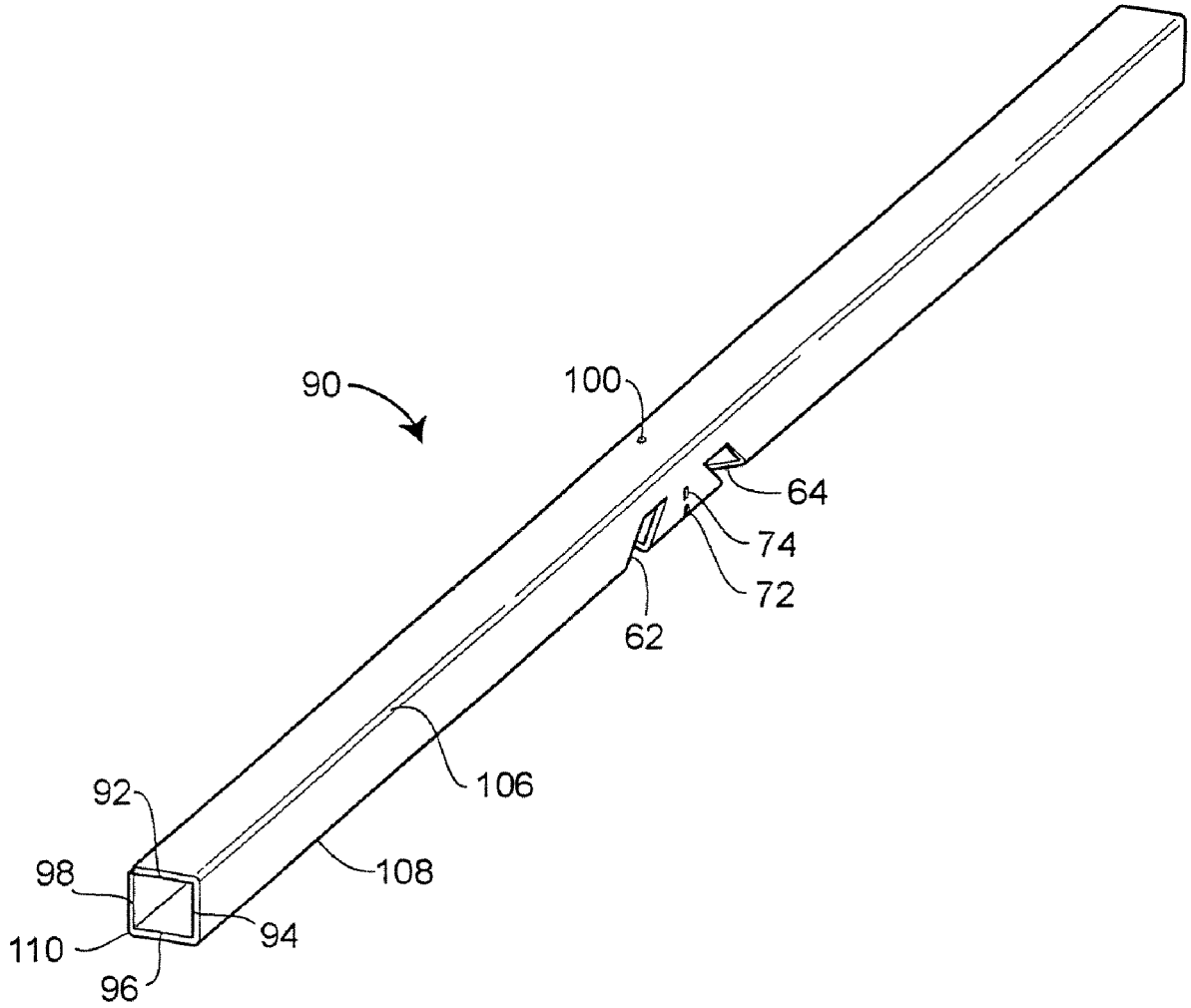
FIG. 11 is a perspective view of a further alternative embodiment of a bottom rail of the temporary window covering of FIG. 2 in a packaged configuration.

In one embodiment of a temporary window covering in accordance with the invention, the bottom rail may also function as the packaging for the temporary window covering. In this embodiment, the bottom rail may include the top, front and rear sides as previously described, along with an additional fourth side that may form one side of the packaging and also provide a point of attachment for one of the other sides to form the triangular cross section of the bottom rail as previously described during installation of the window covering. Referring to FIG. 11, the bottom rail 90 is illustrated in the packaging configuration. The bottom rail 90 may be formed from a single piece of cardboard or other semi-rigid but bendable material that may provide sufficient structural support to function as the bottom rail of the temporary window covering. The material forming the bottom rail 90 may be subdivided into top side 92, front side 94, rear side 96 and a fourth side 98 at horizontal creases 106, 108 and 110 running the entire width of the bottom rail 90. The top side 92, front side 94 and rear side 96 are similar to the corresponding sides 46-50 of the bottom rail 42. In this embodiment, notches 62 and 64 and slots 72 are formed in the front side 94 and rear side 96, and the hole 74 is formed in front side 94. In addition, as previously discussed, a hole 100 is formed to the top side 92 so that the cord 40 of the window covering can extend into the bottom rail 90.

As shown in FIG. 11, each of the sides 92-98 is oriented perpendicular to the adjacent sides 92-98, thereby forming an elongated tube having a substantially square cross section. The outer surfaces of the sides 92-98 as shown in FIG. 11 will subsequently form the inner surface of the bottom rail 90 when the bottom rail 90 is configured for installation, and the inner surfaces of the sides 92-98 will constitute the external surfaces of the bottom rail 90 at installation. The pleated cover and other components of the window covering (not shown) are disposed within the bottom rail 90 when the bottom rail 90 is configured as shown in FIG. 11. The pleated cover may have the bottom-most pleat attached to the inner surface of the top side 92, with the cord 40 extending through the hole 100 and the excess portion of the cord 40 being disposed on the exterior of the bottom rail 90. The attachment of the pleated cover and configuration of the cord for use after assembly will be discussed more thoroughly hereinafter.

Figure 12:
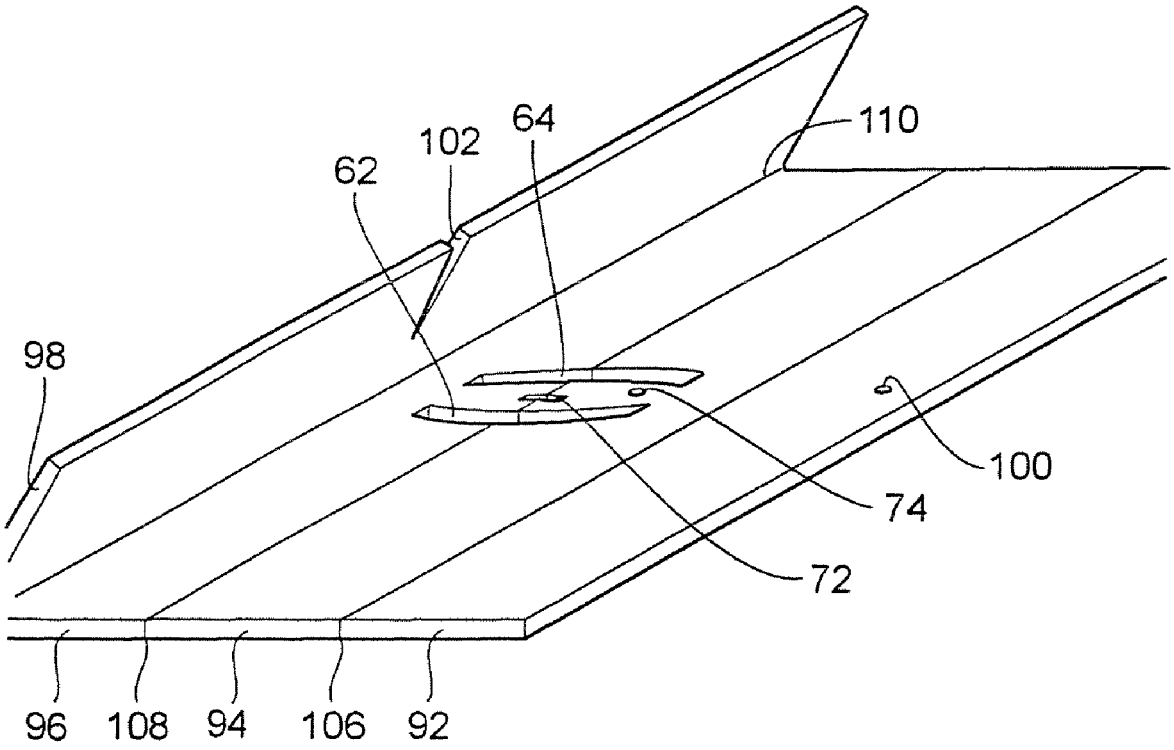
FIG. 12 is a perspective view of the bottom rail of FIG. 11 in a first intermediate position.

Turning to FIG. 12, the bottom rail 90 is illustrated in an intermediate position between the packaging configuration of FIG. 11 and the installed configuration discussed hereinafter. For illustrative purposes only, the bottom rail 90 is shown without the other components of the window covering. However, the pleated cover would be attached to the underside of the top side 92 as shown with the cord 40 extending through the hole 100. In order to accommodate the cord 40 passing through the holes 74 and 100, the fourth side 98 includes a cut-out portion 102 that allows the cord 40 to extend from hole 100 to hole 74 when the bottom rail 90 is fully assembled. As shown in FIG. 12, the cut-out portion 102 may be in the form of a notch cut into the fourth side 98 and extending from the outer edge of the fourth side 98 inwardly towards the crease 110 dividing the fourth side 98 from the rear side 96. While the cut-out portion 102 in FIG. 12 is shown as an opening into which and out of which the cord 40 may pass, other embodiments of a cut-out portion of the fourth side 98 are envisioned and described more thoroughly hereinafter.

Figure 13:
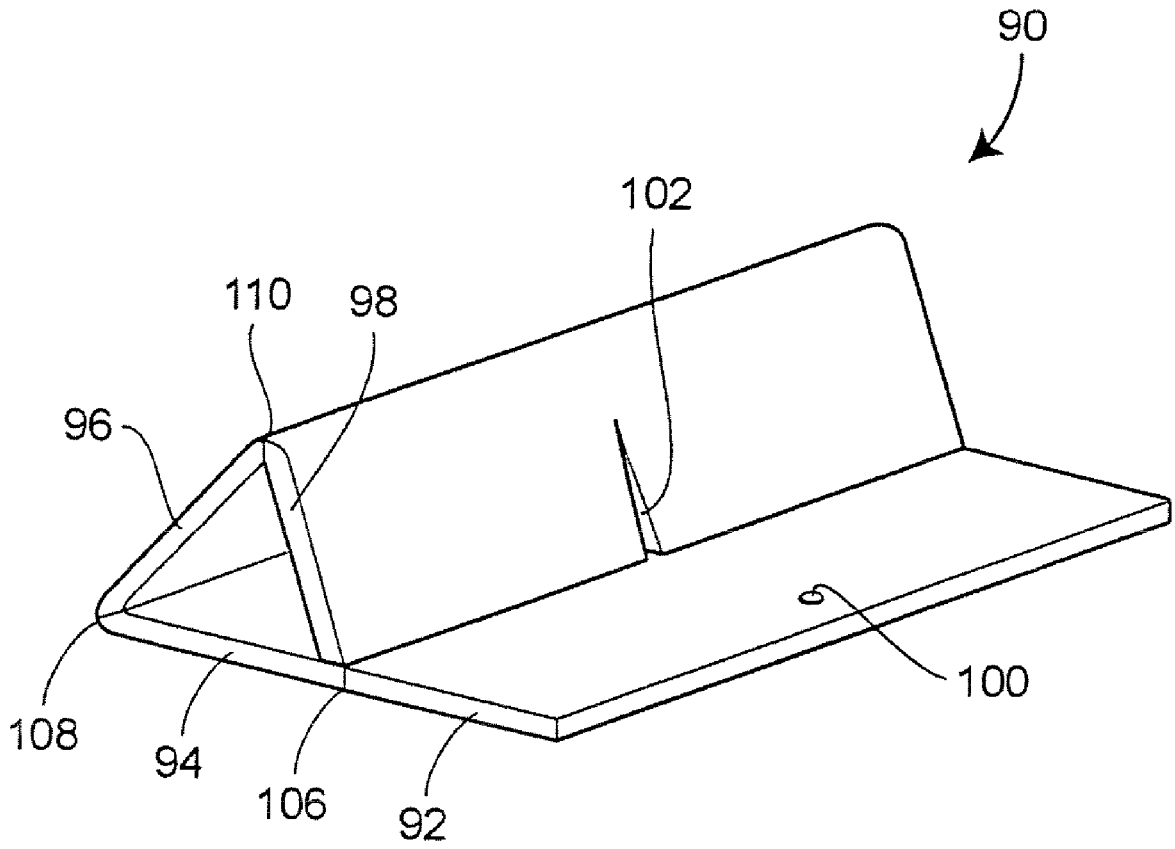
FIG. 13 is a perspective view of the bottom rail of FIG. 11 in a second intermediate position.
Figure 14:
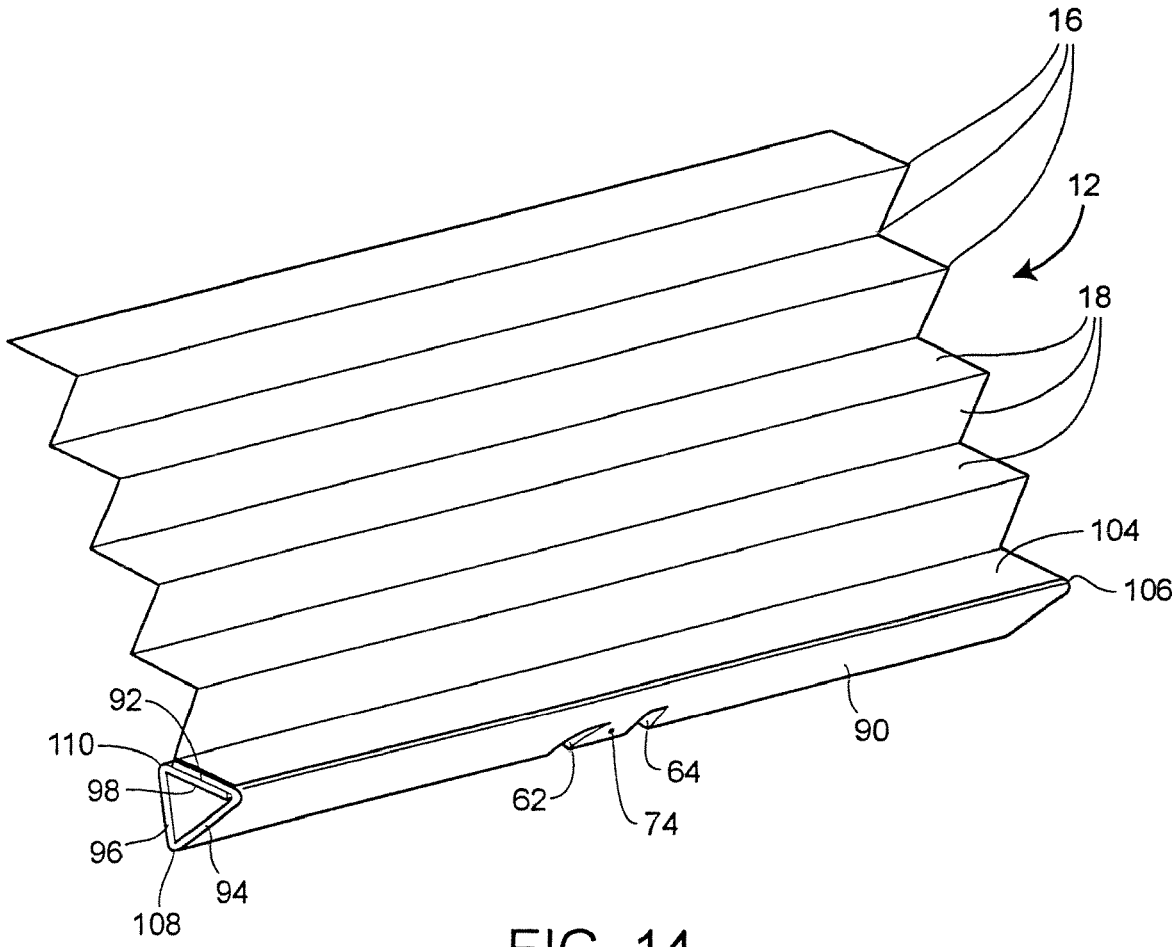
FIG. 14 is a perspective view of the bottom rail of FIG. 11 in an installation configuration and having a pleated cover attached thereto.
Figure 15:
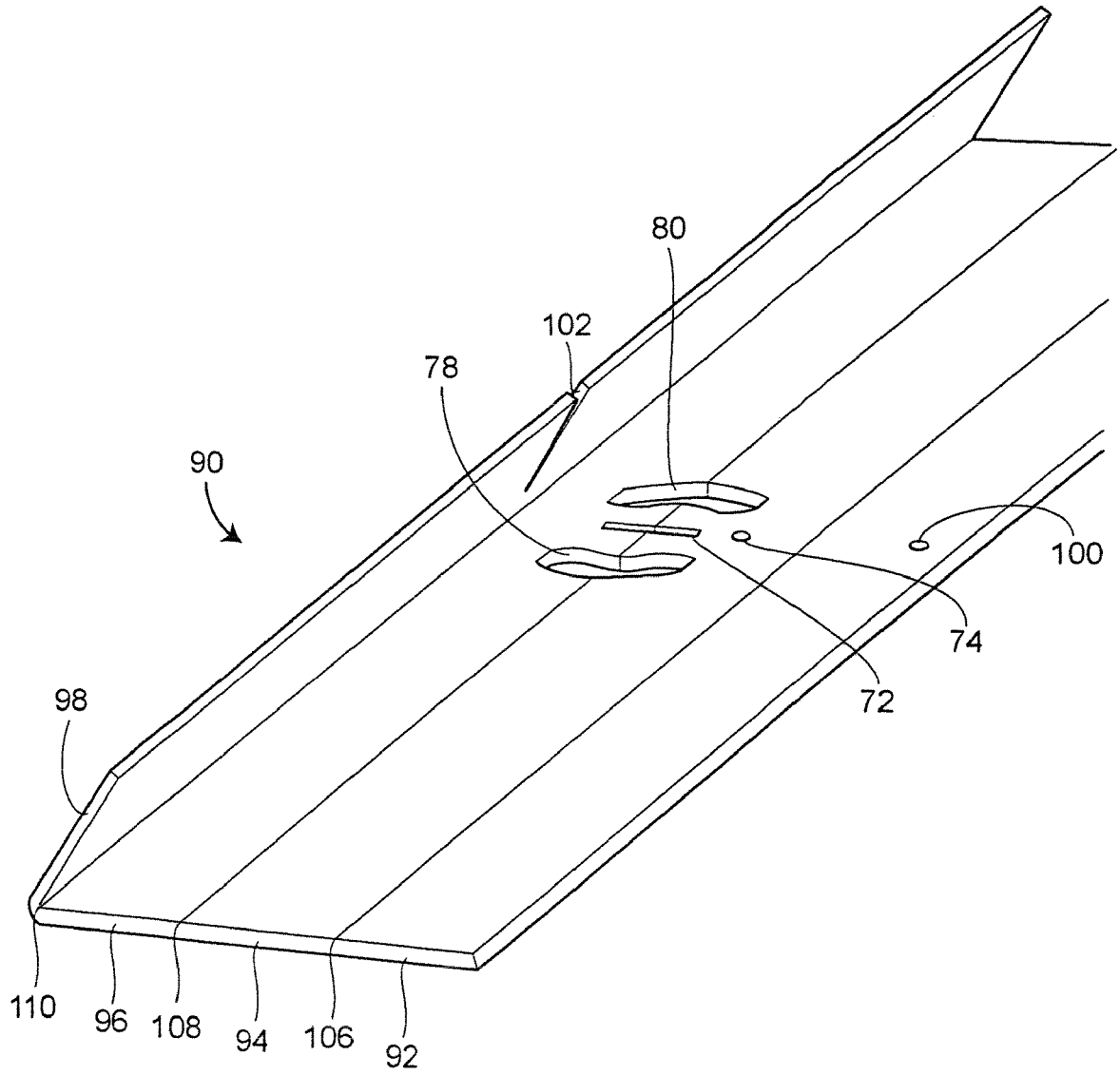
FIG. 15 is a perspective view of an alternative embodiment of the bottom rail of FIG. 11 in a first intermediate position.
Figure 16:
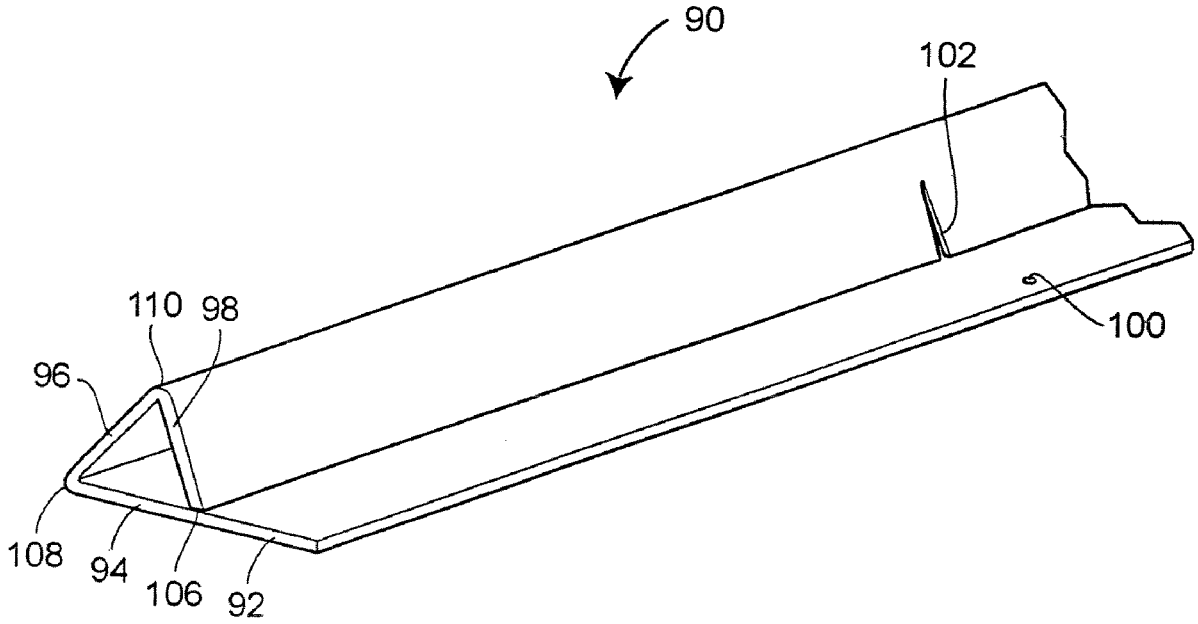
FIG. 16 is a perspective view of the alternative embodiment of the bottom rail of FIG. 11 in a second intermediate position.
Figure 17:
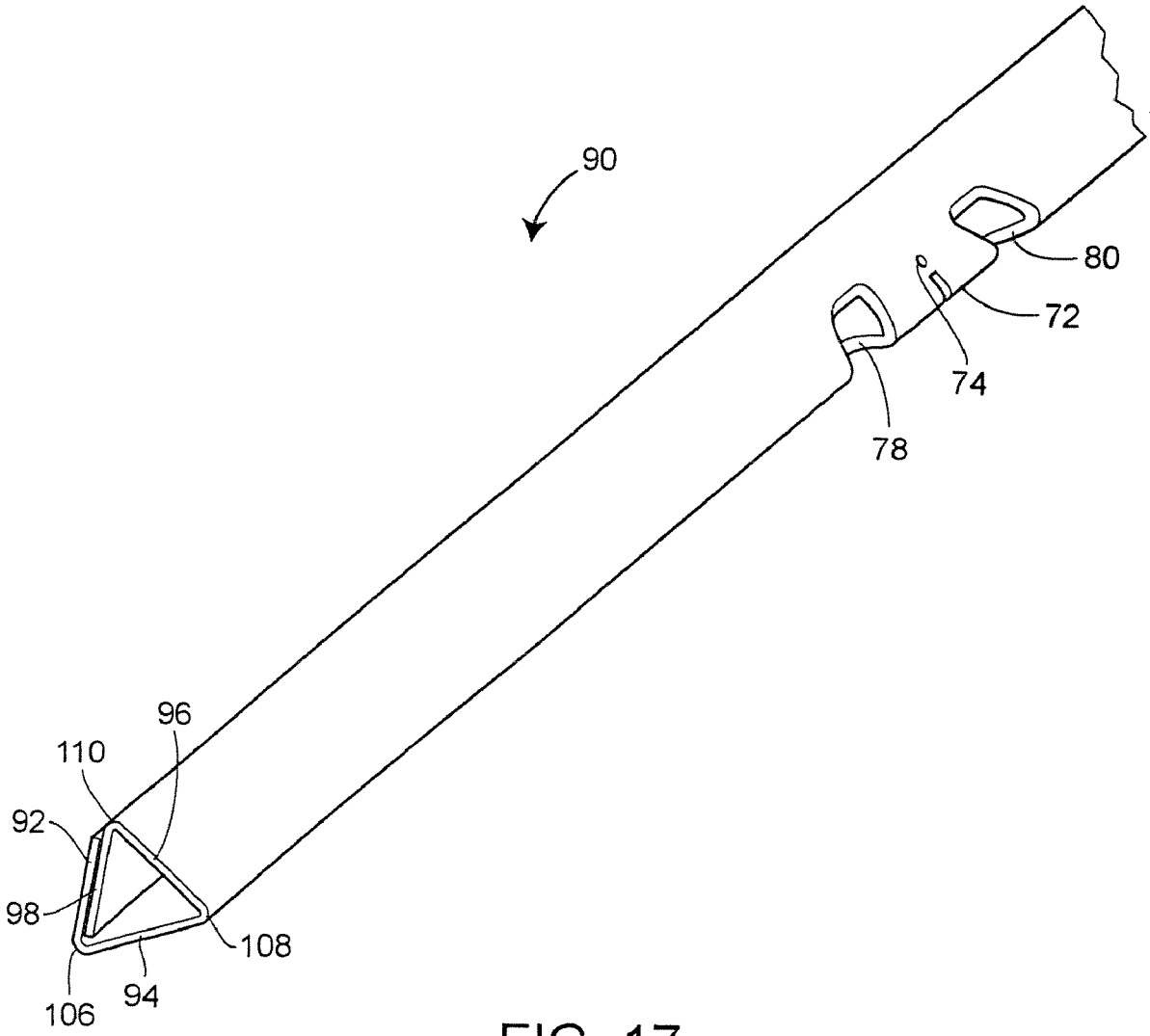
FIG. 17 is a perspective view of the alternative embodiment of the bottom rail of FIG. 11 in an installation configuration.

FIG. 13 illustrates a second intermediate position wherein the rear side 96 is folded over the crease 108 separating the rear side 96 from the front side 94 and toward the front side 94, wherein the free end of the fourth side 98 is disposed proximate the crease 106 separating the top side 92 from the front side 94. As will be discussed further hereinafter, the cord 40 extending out of the hole 100 passes through the cut-out portion 102 of fourth side 98 to the inside of the bottom rail 90 and through the hole 74 (not shown). The assembly of the bottom rail 90 to the installation configuration is completed by folding the top side 92 about the crease 106 separating the top side 92 from the front side 94, and thereby bringing the surface of the top side 92 into contact with the surface of the fourth side 98. The top side 92 may be secured to the fourth side 98 with an adhesive or, alternatively, by clipping the ends of the sides 92 and 98 together using some other fastener or fastening mechanism. FIG. 14 illustrates the fully assembled bottom rail 90 with the pleated cover 12 attached thereto at the bottommost pleat 104. Once the bottom rail 90 is configured and the pleated cover 12 is sized and/or installed at an opening, the cord 40 may extend outwardly through the hole 72 so that the bottom rail 90 may be adjusted and the cord 40 secured to the bottom rail 90 in the manner previously described. FIGS. 15-17 illustrate the intermediate and assembled positions of a bottom rail 90 as illustrated and described with respect to FIGS. 12 through 14, respectively, the bottom rail 90 incorporating notches 76 and 78 as described previously in FIGS. 9 and 10.

Figure 18:
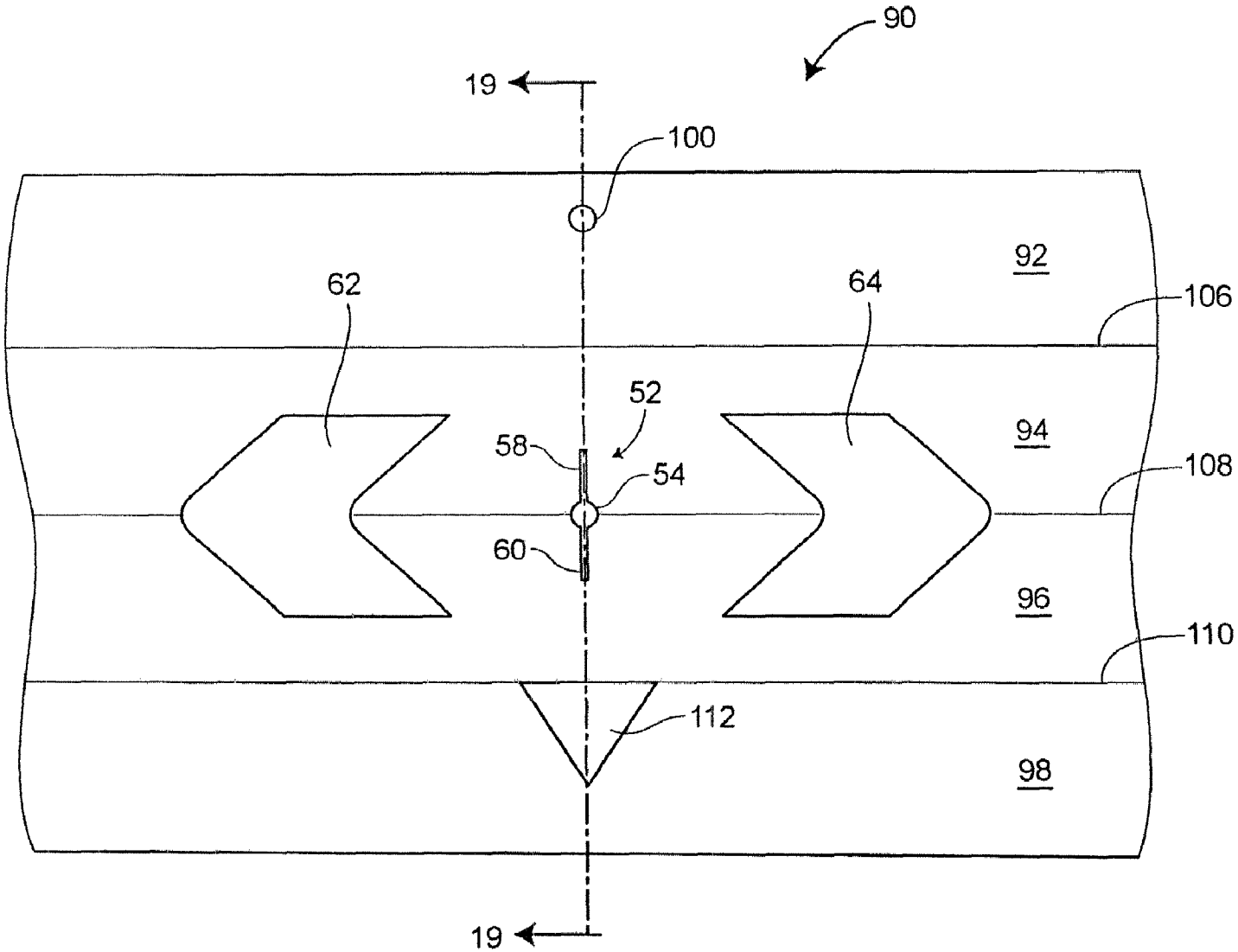
FIG. 18 is a top view of an alternative embodiment of the bottom rail of FIG. 11 laid out flat.

FIG. 18 illustrates one embodiment of the bottom rail 90 wherein the top side 92, front side 94, rear side 96 and fourth side 98 are defined by creases 106, 108 and 110. In this embodiment, top side 92 includes hole 100 therethrough, and the front side 94 and rear side 96 includes slot 52 and notches 62 and 64 therethrough. As previously discussed with respect to FIG. 3, the slot 52 includes a rounded center opening 54 and narrow portions 58 and 60 in the front side 94 and rear side 96, respectively. The fourth side 98 includes a cut-out portion 112 aligned with the slot 52 and hole 100, and disposed proximate the crease 110 between the rear side 96 and the fourth side 98.

In the embodiments described herein for the bottom rail 90, the holes, slots, notches and cut-out portions may be cut out and completely removed from the bottom rail 90 during the manufacture of the window covering. Alternatively, the material forming the bottom rail 90 may be perforated such that the holes, slots, notches and cut-out portions are defined but not removed during the manufacture of the window coverings. The perforated portions of the bottom rail 90 may subsequently be punched out by the customer during the installation of the window covering. If some or all of the holes, slots and cut-out portions must be punched out during installation, the customer may be required to thread the free end of the cord 40 through the holes, slots and cut-out portions during the installation process.

Figure 19A:
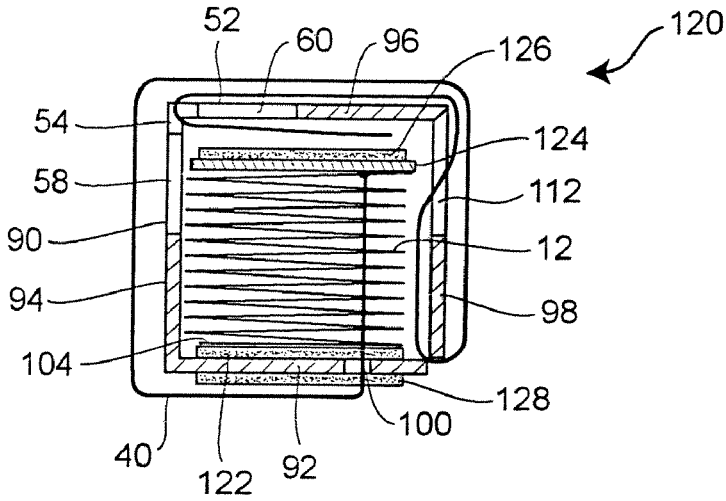
FIG. 19A is a side cross-sectional view through line 19-19 of a temporary window covering incorporating the bottom rail of FIG. 18 in a packaged configuration.
Figure 19B:
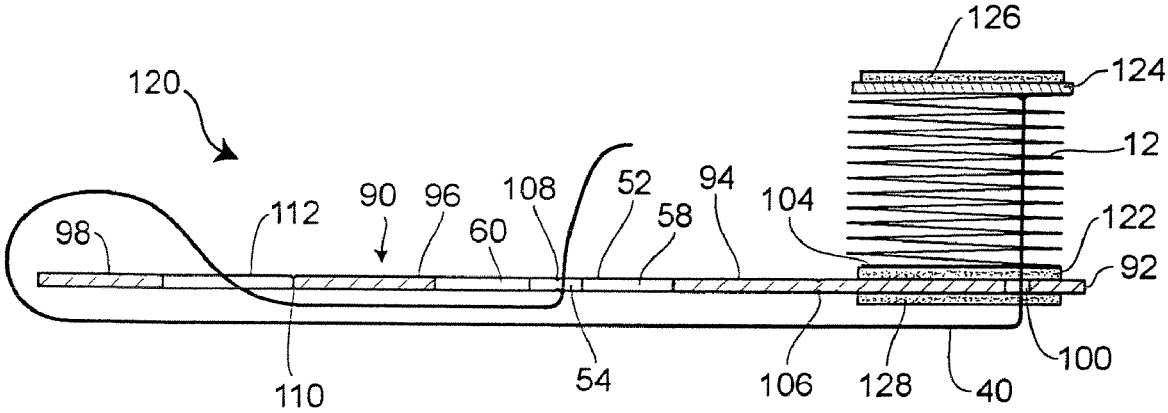
FIG. 19B is a side cross-sectional view through line 19-19 of a temporary window covering incorporating the bottom rail of FIG. 18 in an intermediate position.
Figure 19C:
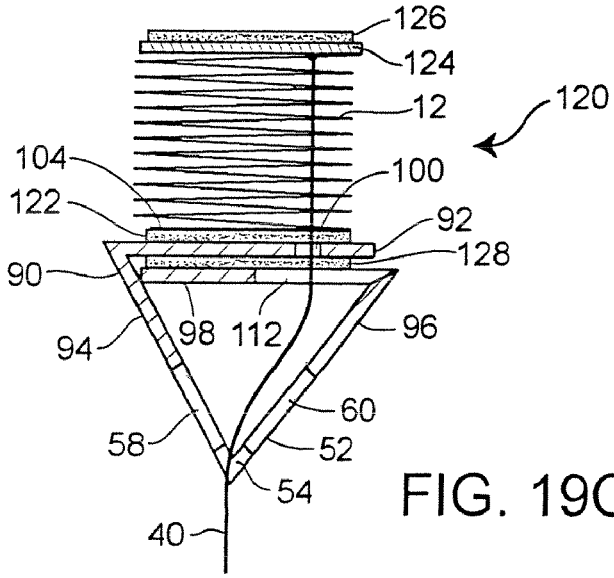
FIG. 19C is a side cross-sectional view through line 19-19 of a temporary window covering incorporating the bottom rail of FIG. 18 in an installation configuration.

FIGS. 19A-C illustrate the initial steps of the installation process of a window covering 120 utilizing the bottom rail 90 of FIG. 18. FIG. 19A illustrates the window covering 120 in the packaged configuration. The pleated cover 12 is disposed within the bottom rail 90 with the bottommost pleat 104 attached to the surface of the top side 92 by a first adhesive layer 122. The window covering may further include a top rail 124 attached to the top of the pleated cover 112 with a second adhesive layer 126 being disposed thereon. The second adhesive layer 126, which may have a removeable protective strip disposed thereon prior to installation, may be attached to a structure defining the top of the opening being covered by the temporary window covering 120. The window covering 120 may further include a third adhesive layer 128 which may be disposed on the surface of the top side 92 opposite the first adhesive layer 122 for use in securing the top side 92 to the fourth side 98 during the installation of the window covering 120. The third adhesive layer 126 may also have a removeable protective strip disposed thereon prior to installation.

The cord 40 may have a first end attached to the top rail 124 and may be threaded through the holes 18 in the pleats 14 of the pleated cover 12 and pass through the hole 100 in the top rail 92. In order to facilitate installation by the customer, the free end of the cord 40 may also be threaded through the slot 52 such that the customer need only to reconfigure the bottom rail 90 during installation without having to thread the free end of the cord 40 through the slot 52. Because the cut-out portion 112 does not have an opening through which the cord 40 can pass after being threaded through the hole 100 and slot 52, the cord 40 must also be threaded through the cut-out portion 112 prior to being threaded through the slot 52. Consequently, as shown in FIG. 19A, the cord 40 must be wrapped around the top side 92, front side 94, rear side 96, fourth side 98, pass through the opening between the edges of the top side 92 and the fourth side 98, pass through the cut-out portion 112, travel back across the rear side 96 and through the rounded center opening 54 of the slot 52, with the remaining portion of the cord 40 being disposed within the bottom rail 90.

Referring now to 19B, the window covering 120 is illustrated with the bottom rail 90 unfolded to a flat intermediate position with the front side 94, rear side 96, and fourth side 98 having been rotated about the creases 106, 108 and 110, respectively. FIG. 19C illustrates the window covering 120 with the bottom rail 90 configured for installation. The front side 94, rear side 96 and fourth side 98 have been further rotated to configure the bottom rail 90 with the triangular cross section with the bottom surface of the top side 92 being attached to the top surface of the fourth side 98 by the third adhesive layer 128. Because the cord 40 was threaded as previously described, the cord 40 passes directly through the hole 100, cut-out portion 112 and rounded center opening 54 of the slot 52. The window covering 120 may now be installed at an opening by applying the second adhesive layer 126 to a surface proximate the top of the opening to be covered. Once installed, the bottom rail 90 is moved to a desired position, the cord 40 may be pulled into one of the narrow portions 58 or 60 to secure the bottom rail 90 in place as previously described.

Figure 20:
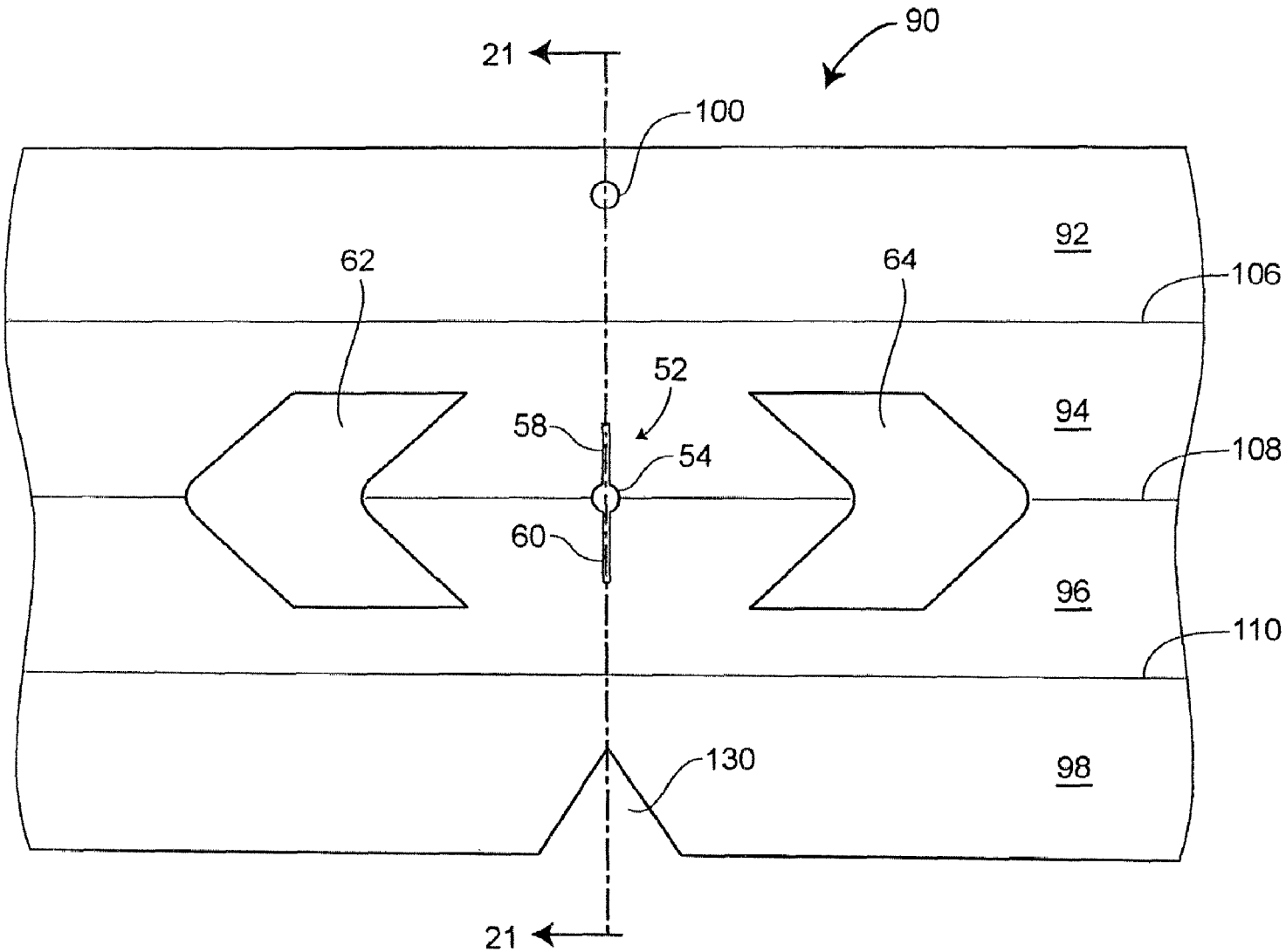
FIG. 20 is a top view of another alternative embodiment of the bottom rail of FIG. 11 laid out flat.
Figure 21A:
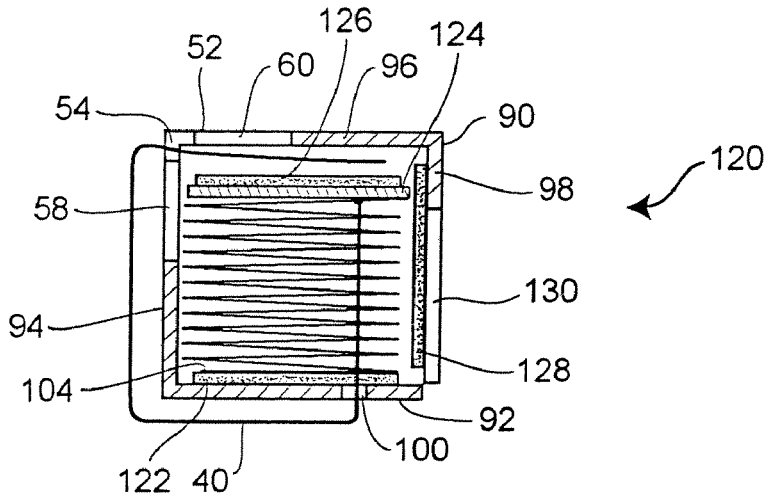
FIG. 21A is a side cross-sectional view through line 21-21 of a temporary window covering incorporating the bottom rail of FIG. 20 in a packaged configuration.
Figure 21B:
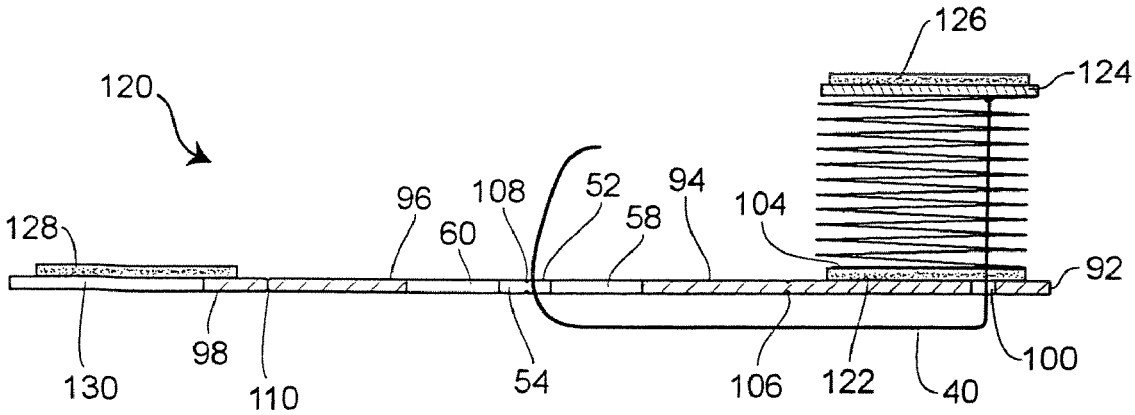
FIG. 21B is a side cross-sectional view through line 21-21 of a temporary window covering incorporating the bottom rail of FIG. 20 in an intermediate position.
Figure 21C:
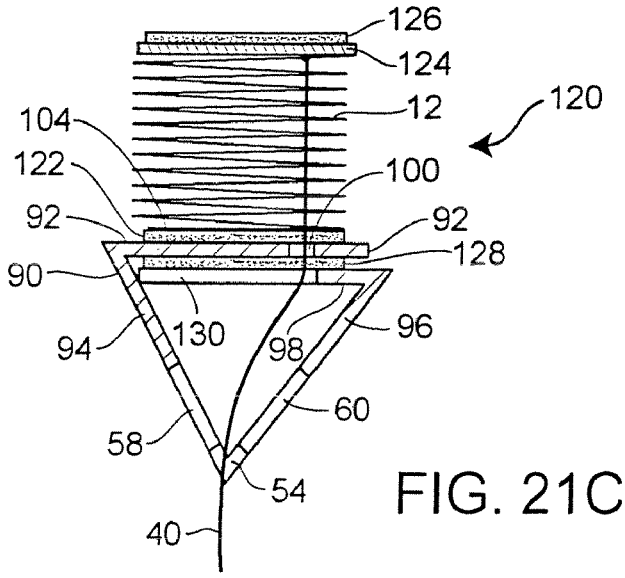
FIG. 21C is a side cross-sectional view through line 21-21 of a temporary window covering incorporating the bottom rail of FIG. 20 in an installation configuration.

FIG. 20 illustrates an alternative embodiment wherein the bottom rail 90 includes a cut-out portion 130 in the fourth side 98 disposed at the edge of the bottom rail 90 such that an opening exists for the cord 40 to enter the cut-out portion 130 after the cord has been threaded through the hole 100 and slot 52. FIGS. 21A-C illustrate the process previously described with respect to FIGS. 19A-C for converting the bottom rail 90 from the packaging configuration to the installation configuration. Referring to FIG. 21A, because the cut-off portion 130 includes an open end at the edge of the fourth side 98, the cord 40 need not be threaded through the cut-out portion 130 prior to threading the cord 40 through the rounded center opening 54 of the slot 52. Consequently, the cord 40 is wrapped around the top side 92 and front side 94, and threaded through the rounded center opening 54 with the excess portion of the cord 40 being disposed within the bottom rail 90. FIGS. 21A-C illustrate a further alternative embodiment wherein the third adhesive layer 128 is disposed on a surface of the fourth side 98. In FIGS. 21B and 21C, the front side 94, rear side 96, and fourth side 98 are rotated about the creased 106-110, respectively, to configure the bottom rail 90 with the triangular cross section as shown in FIG. 21C in a similar manner as previously described with respect to FIGS. 19B and 19C. As the fourth side 98 is rotated about the crease 110, the portion of the cord 40 disposed between the hole 100 and the slot 52 pass into the cut-out portion 130. Once the surface of the top side 92 is secured to the surface of the fourth side 98 by the third adhesive layer 128, the cord 40 passes through the hole 100 and cut-out portion 130 and out of the bottom rail 90 through the rounded center opening 54 of the slot 52.

Figure 22:
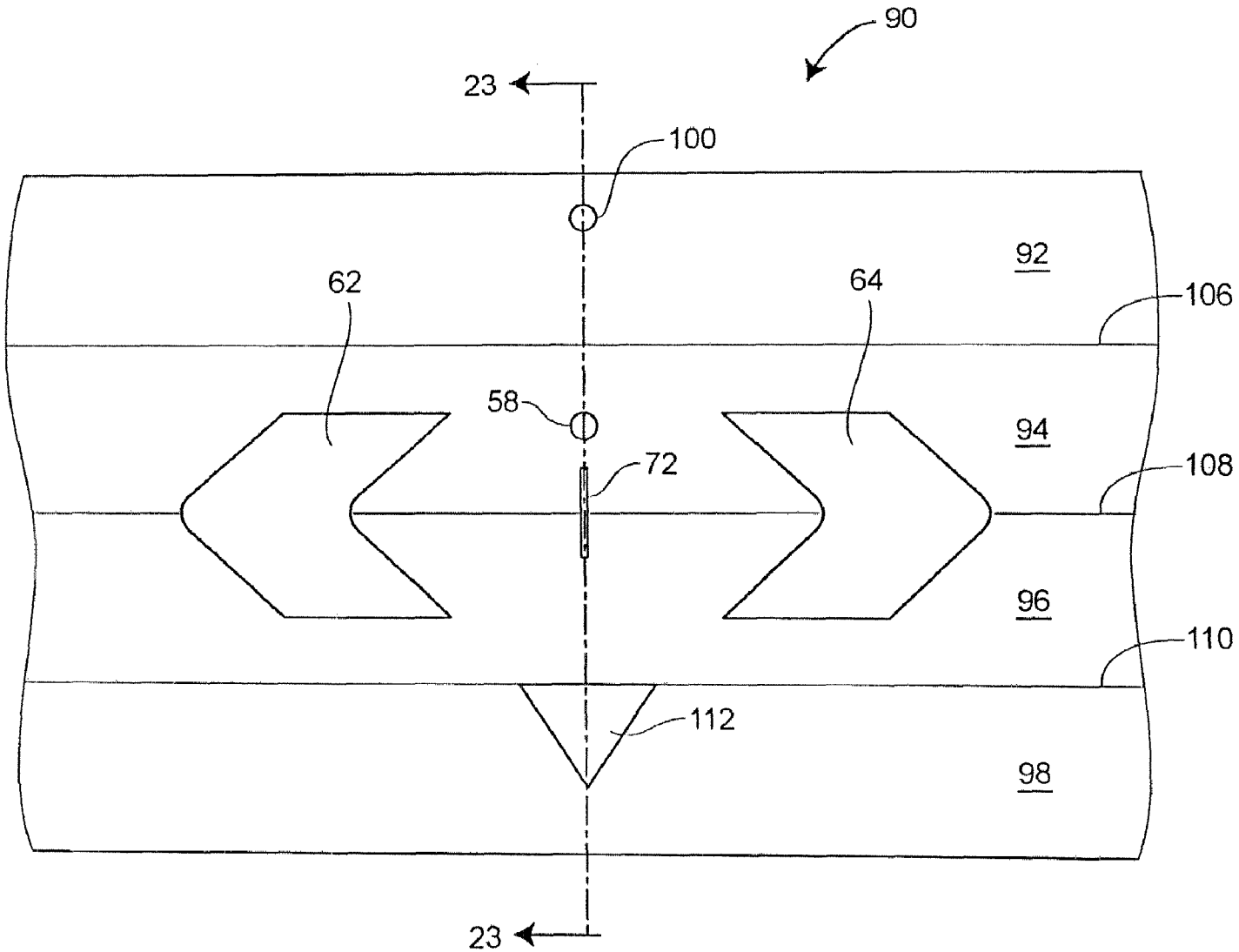
FIG. 22 is a top view of a further alternative embodiment of the bottom rail of FIG. 1 laid out flat.
Figure 23A:
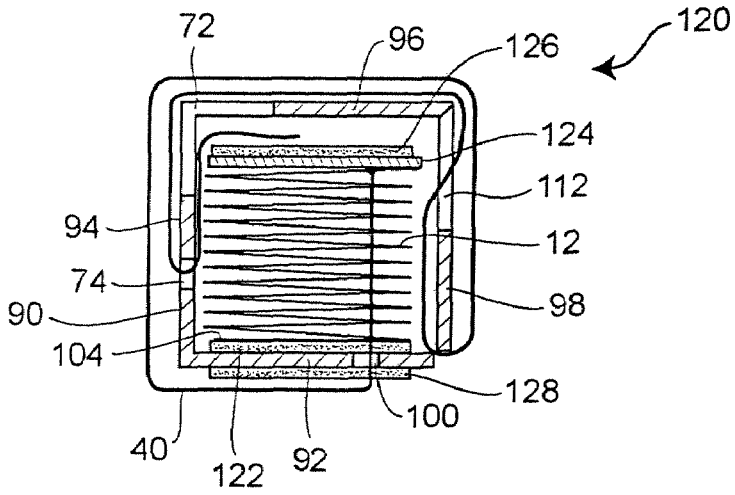
FIG. 23A is a side cross-sectional view through line 23-23 of a temporary window covering incorporating the bottom rail of FIG. 22 in a packaged configuration.
Figure 23B:
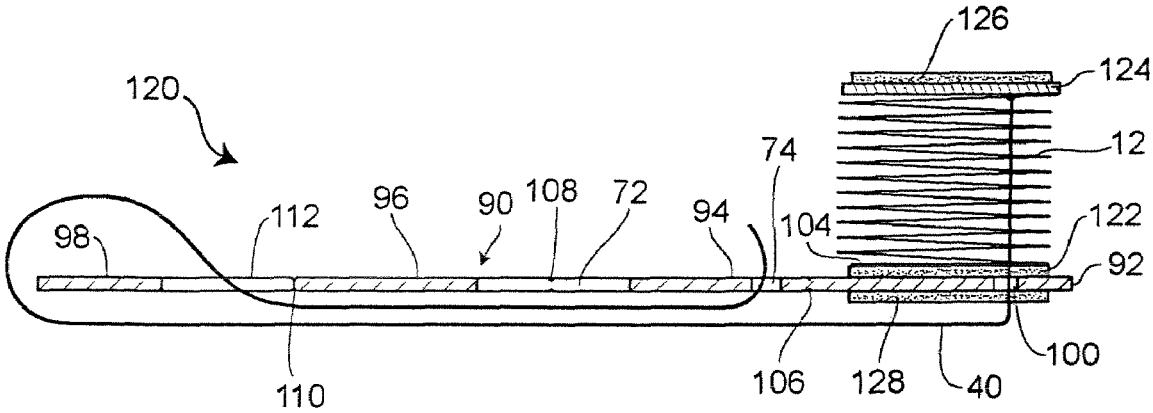
FIG. 23B is a side cross-sectional view through line 23-23 of a temporary window covering incorporating the bottom rail of FIG. 22 in an intermediate position.
Figure 23C:
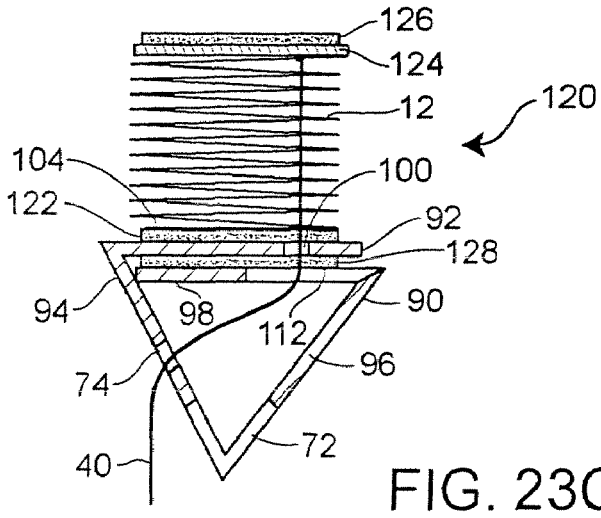
FIG. 23C is a side cross-sectional view through line 23-23 of a temporary window covering incorporating the bottom rail of FIG. 22 in an installation configuration.

FIG. 22 illustrates a further embodiment of the bottom rail 90 wherein the slot 52 is replaced by the slot 72 and hole 74 as illustrated and described with reference to FIGS. 8-10. As illustrated in FIGS. 23A-C, the cord 40 is threaded through the cut-out portion 112 before being threaded through the hole 74 in side 94. Referring to FIG. 23A, after the cord 40 passes through cut-out portion 112, the cord is wrapped around the rear side 96 and front side 94, and through the hole 74. Once the bottom rail 90 is reconfigured with the triangular cross section as shown in FIG. 23C, the cord 40 passes through the hole 100 and cut-out portion 112 before passing out of the bottom rail 90 through the hole 74. When the bottom rail is moved to the desired position, the free end of the cord 40 is pulled through the slot 72 to secure the bottom rail 90 in the manner previously described.

Figure 24:
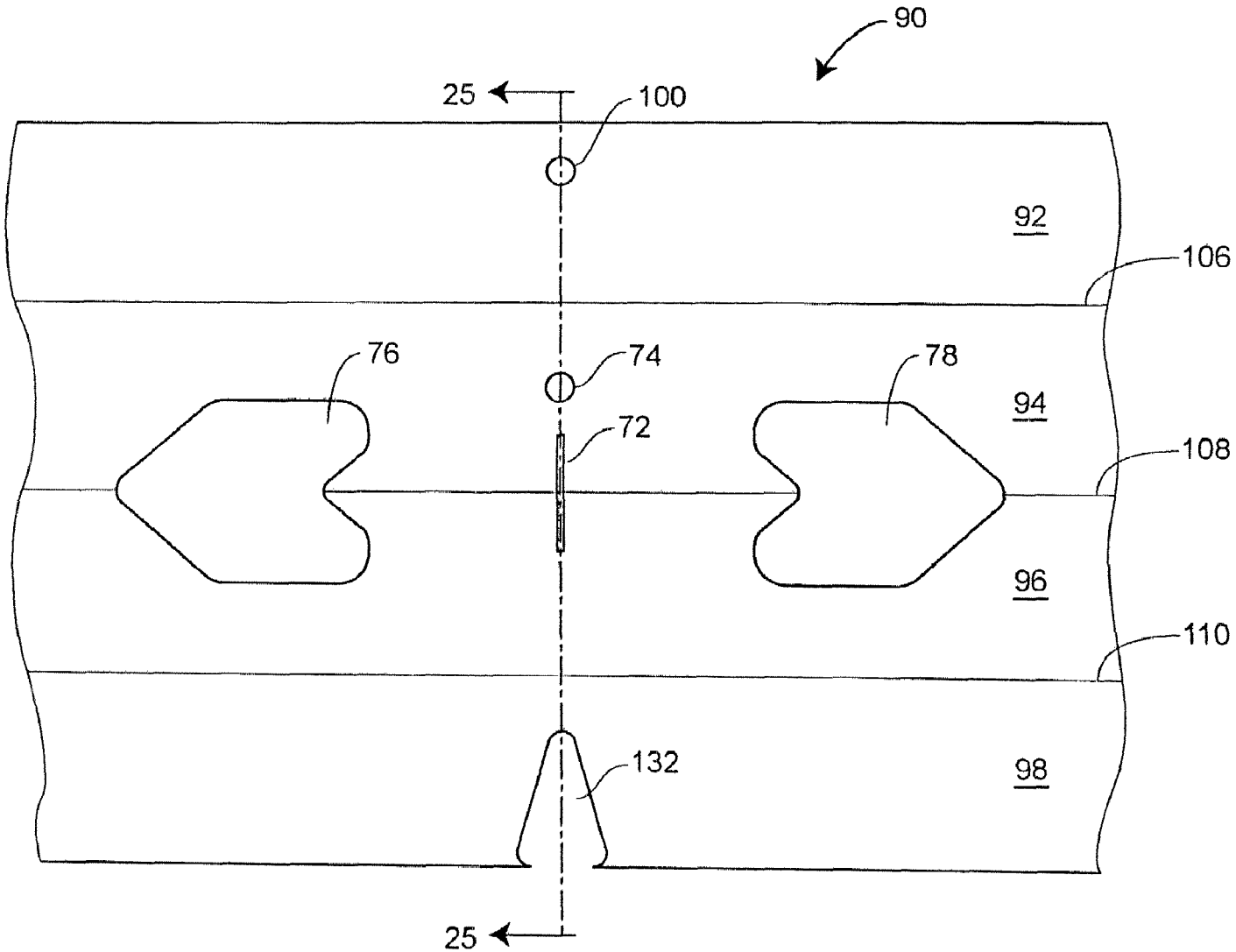
FIG. 24 is a top view of a still further alternative embodiment of the bottom rail of FIG. 11 laid out flat.
Figure 25A:
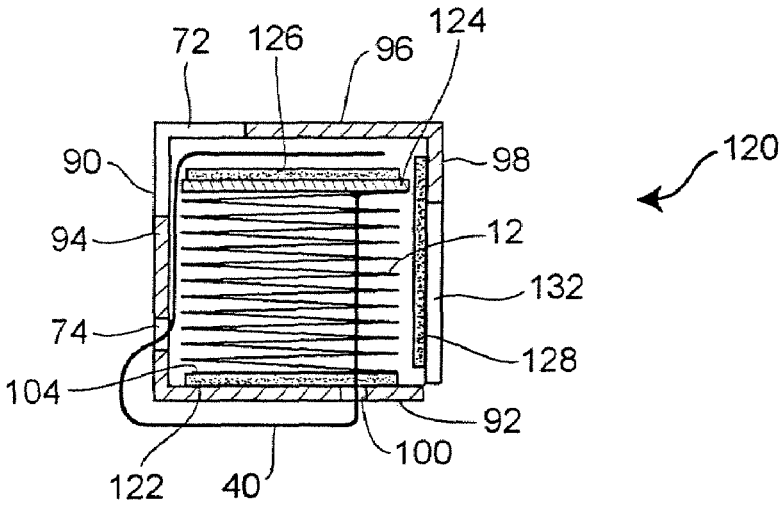
FIG. 25A is a side cross-sectional view through line 25-25 of a temporary window covering incorporating the bottom rail of FIG. 24 in a packaged configuration.
Figure 25B:
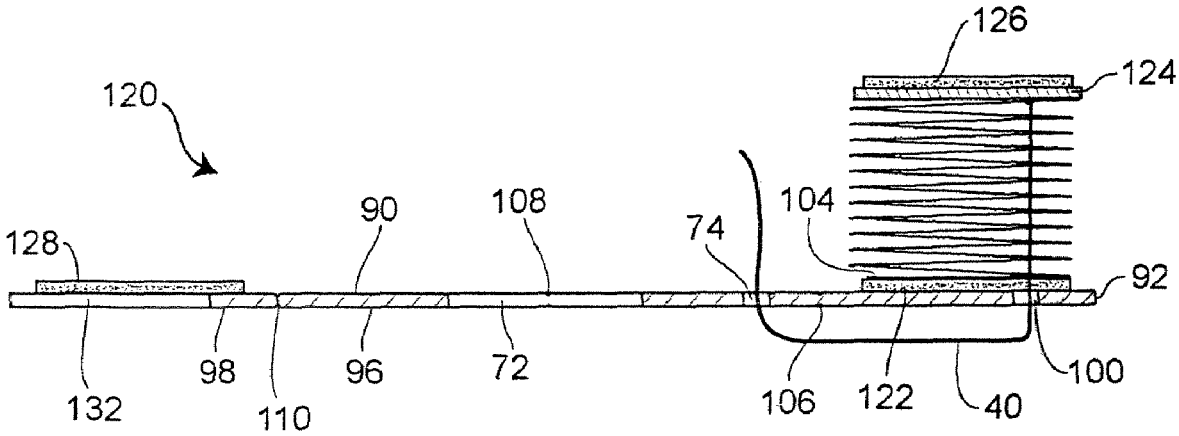
FIG. 25B is a side cross-sectional view through line 25-25 of a temporary window covering incorporating the bottom rail of FIG. 24 in an intermediate position.
Figure 25C:
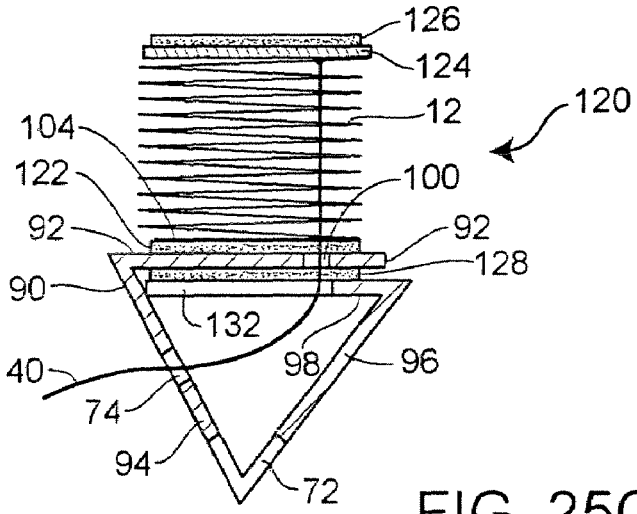
FIG. 25C is a side cross-sectional view through line 25-25 of a temporary window covering incorporating the bottom rail of FIG. 24 in an installation configuration.

FIG. 24 illustrates a further embodiment of the bottom rail 90 having notches 76 and 78 as illustrated and described with respect to FIGS. 9 and 10, and an alternative embodiment of a cut-out portion 132 in side 98 disposed proximate the edge of the bottom rail 90. As illustrated in FIGS. 25A-C, the cord 40 is threaded through holes 100 and 74 without being threaded through the cut-out portion 132. When the fourth side 98 is rotated about the crease 110 to the position shown in FIG. 25C, the portion of the cord between the holes 100 and 74 passes into the cut-out portion 132 through the opening in the edge of bottom rail 90.

Figure 26:
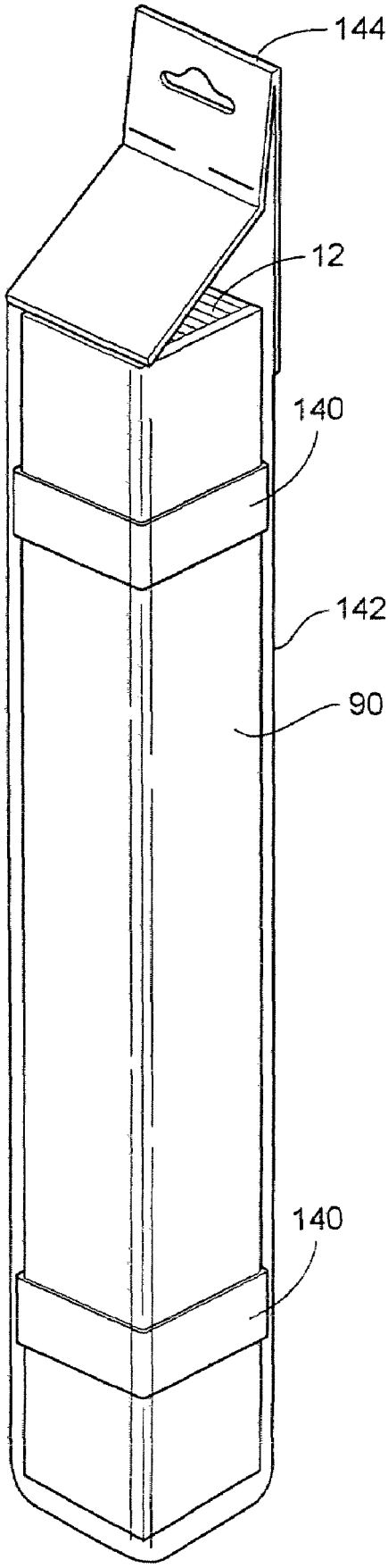
FIG. 26 is a side perspective view of a temporary window covering wrapped in packaging material.

As previously discussed, the bottom rail 90 of the temporary window covering functions as a portion of the packaging for the window covering. FIG. 26 illustrates one alternative packaging configuration for the temporary window covering. The side of the bottom rail 90 may be held in place by slip bands 140 disposed on the exterior surface of the bottom rail 90. The slip bands 140 may be slid over the ends of the bottom rail 90 and positioned such that the edges of the top side 92 and fourth side 98 remain in close proximity to enclose the pleated cover 12. The packaging may further include a wrapper 142 enclosing the window covering, which may be made of plastic, cellophane, paper or other flexible material shaped generally to conform to the configuration of the bottom rail 90. The wrapper 142 may be partially or wholly transparent to allow the customer to view the contents. Still further, the packaging may include a hanger tab 144 attached to the wrapper 142 proximate the top of the wrapper 142 to facilitate handling the package in a store display.

Figure 27:
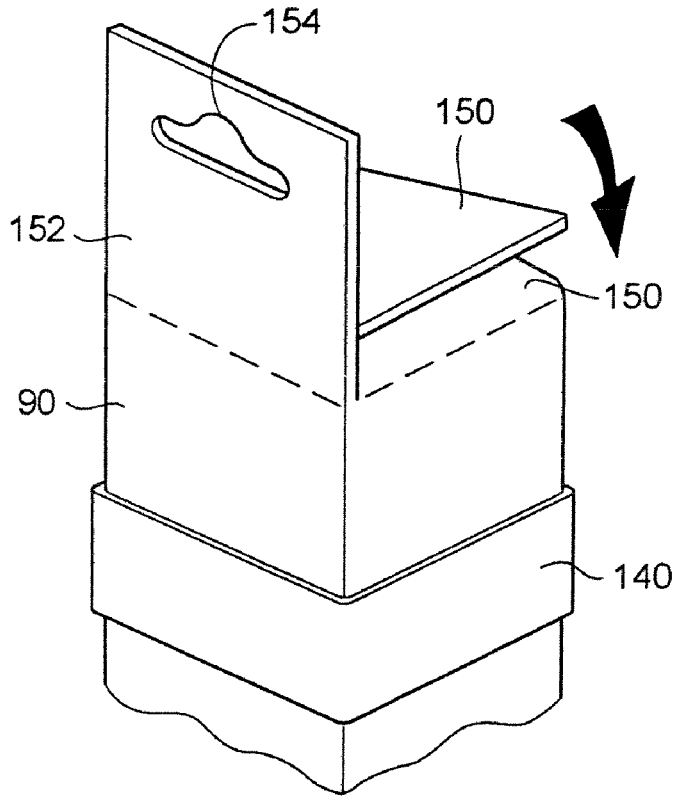
FIG. 27 is a side perspective view of a top portion of a temporary window covering having an alternative packaging configuration.

In lieu of the wrapper 142 and hanging tab 144, components for enclosing the bottom rail 90 and displaying the window covering may be integrally formed with the bottom rail 90. As shown in FIG. 27, the ends of the bottom rail 90 may include one or more tabs 150 integrally formed in the ends of the sides of the bottom rail 90. The tabs 150 may be creased or perforated so that the tabs 150 may fold over the open end of the bottom rail 90, thereby enclosing the interior of the bottom rail 90. The end of the bottom rail 90 may further include a hanging tag 152 integrally formed at the end of one of the sides of the bottom rail 90, and including a hole 154 that may be used to hang the window covering in a display. As with the side tabs 150, the hanging tag 152 may be perforated to facilitate removal of the hanging tag 152 when the customer opens the package and installs the window covering.

Figure 28:
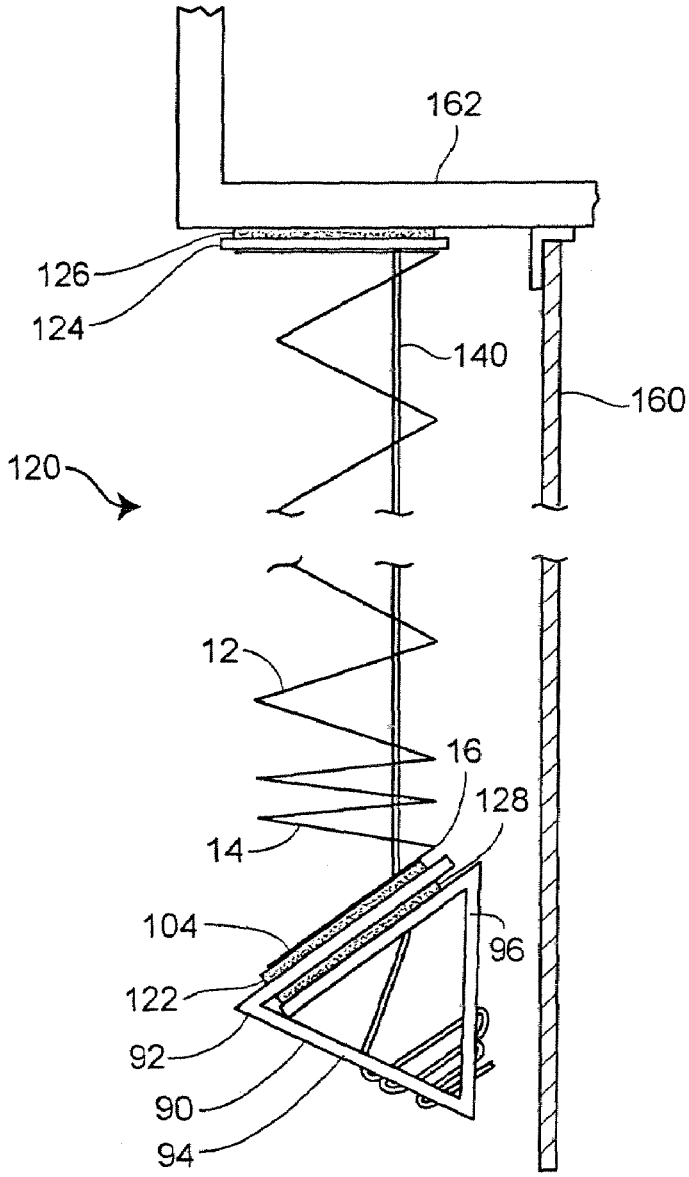
FIG. 28 is a side view of the temporary window covering of FIGS. 24 and 25A-C installed to cover an opening.

FIG. 28 illustrates the window covering 120 of FIGS. 24 and 25A-C installed to cover an opening for a window 160. The opening for the window 160 may be defined at least in part by an upper part of the window frame 162 or other support structure to which the window 160 mounted. The window covering 120 is installed at the opening by attaching the top rail 124 of the window covering 120 to the window frame 160 via the second adhesive layer 126. It may be necessary to remove the removable protective strip disposed thereon to expose the adhesive layer to the window frame 160. As shown in FIG. 28, the bottom rail 90 has been positioned and the excess portion of the cord 40 extending out of the hole 74 (not shown) has been pulled through the slot 72 (not shown) and wrapped around the notches 76 and 78 (not shown). The bottommost pleat 104 is attached to the top side 92 of the bottom rail 90 such that the crease 16 between the bottommost pleat 104 and the next pleat 14 is disposed proximate the rear side 96 of the bottom rail 90. Configured in this way, the weight of the bottom rail 90 tends to rotate the bottom rail 90 rearwardly (counter-clockwise in FIG. 28) toward the window 160. As the bottom rail 90 rotates toward the window 160, the excess portion of the cord 40 wrapped on the bottom rail 90 may be partially or completely hidden from an observer positioned on the side of the window covering 120 opposite the window 160. Of course, the amount of rotation of the bottom rail 90 may be adjusted by various factors, such as the positioning of the holes in the pleated cover 12 and bottom rail 90, the amount of excess cord 40 extending outwardly from the bottom rail 90, weighting on the bottom rail 90, positioning of the crease 16 of the bottommost pleat and the bottom rail 90, and the like.

What is claimed is:

1. A temporary window covering, comprising:

a pleated cover formed from a sheet of material having a plurality of horizontal creases extending across the width of the sheet thereby defining a plurality of pleats, the pleated cover being moveable between a retracted position wherein each of the pleats is substantially horizontally aligned and in contact with the adjacent pleats, an extended position wherein each of the pleats is substantially vertical and substantially vertically aligned with the other pleats, and a plurality of intermediate positions wherein at least some of the pleats are oriented between the pleats' retracted positions and the pleats' extended positions; and a bottom rail formed from a plurality of interconnected sides each having a width approximately equal to the width of the sheet and with one of the sides being attached to a bottommost pleat of the pleated cover, the sides of the bottom rail being moveable relative to each other between a packaging configuration wherein the sides of the bottom rail enclose and engage the pleated cover, with the engagement of the sides of the bottom rail preventing the covering from being extended to the extended position, and a support configuration wherein the sides of the bottom rail do not enclose the pleated cover such that the pleated cover may be extended to the extended position and to intermediate positions with the sides of the bottom rail providing structural support for the bottommost pleat.

2. A temporary window covering according to claim 1, comprising at least one band disposed on an outside surface of the bottom rail when the bottom rail is in the packaging configuration to retain the sides of the bottom rail in the packaging configuration, wherein the sides of the bottom rail are moveable between the packaging configuration and the support configuration when the at least one band is not disposed on the outside surface of the bottom rail.

3. A temporary window covering according to claim 1, comprising a top rail attached to a topmost pleat of the pleated cover, wherein the sides of the bottom rail enclose the top rail and the pleated cover when the bottom rail is in the packaging configuration.

4. A temporary window covering, comprising:

an elongated cover having a top end and a bottom end and a width perpendicular to the direction from the top end to the bottom end, the elongated cover being moveable between a retracted position, an extended position, and a plurality of intermediate positions; and a bottom rail formed from a plurality of interconnected sides each having a width approximately equal to the width of the elongated cover and with one of the sides being attached to the bottom end of the elongated cover, the sides of the bottom rail being moveable relative to each other between a packaging configuration wherein the sides of the bottom rail enclose and engage the elongated cover, with the engagement of the sides of the bottom rail preventing the elongated cover from being extended to the extended position, and a support configuration wherein the sides of the bottom rail do not enclose the elongated cover such that the elongated cover may be extended to the extended position and to intermediate positions with the sides of the bottom rail providing structural support for the bottom end of the elongated cover.

5. A temporary window covering according to claim 4, comprising at least one band disposed on an outside surface of the bottom rail when the bottom rail is in the packaging configuration to retain the sides of the bottom rail in the packaging configuration, wherein the sides of the bottom rail are moveable between the packaging configuration and the support configuration when the at least one band is not disposed on the outside surface of the bottom rail.

6. A temporary window covering according to claim 4, wherein the elongated cover has first and second outer edges on opposite sides of the elongated cover, and wherein one of the sides of the bottom rail comprises at least one tab extending outwardly beyond a corresponding one of the first and second outer edges, the at least one tab being configured to be folded over and disposed over the corresponding one of the first and second outer edges to enclose the one of the first and second outer edges within the bottom rail when the bottom rail is configured in the packaging configuration.

7. A temporary window covering according to claim 4, wherein the elongated cover has first and second outer edges on opposite sides of the elongated cover, and wherein one of the sides of the bottom rail comprises a tab having a hole therethrough extending outwardly beyond a corresponding one of the first and second outer edges.

8. A temporary window covering according to claim 4, comprising a top rail attached to the top end of the elongated cover, wherein the sides of the bottom rail enclose the top rail and the elongated cover when the bottom rail is in the packaging configuration.

9. A temporary window covering, comprising:

an elongated cover having a top end and a bottom end and a width perpendicular to the direction from the top end to the bottom end, the elongated cover being moveable between a retracted position, an extended position, and a plurality of intermediate positions;

a top rail attached to the top end of the elongated cover;

a cord having a first end connected to the top rail; and a bottom rail formed from a plurality of interconnected sides each having a width approximately equal to the width of the elongated cover and with one of the sides being attached to the bottom end of the elongated cover, wherein the bottom rail has a slot disposed through a surface of the bottom rail, the slot configured to receive the cord, and at least a portion of the slot having a width less than the thickness of the cord such that the slot engages the cord to support the weight of the bottom rail and an accumulated portion of the elongated cover when the cord is engaged by the at least a portion of the slot, wherein the sides of the bottom rail are moveable between a packaging configuration wherein the sides of the bottom rail enclose and engage the elongated cover, with the engagement of the sides of the bottom rail preventing the elongated cover from being extended to the extended position, and a support configuration wherein the sides of the bottom rail do not encircle the elongated cover such that the elongated cover may be extend to the extended position and to intermediate positions with the sides of the bottom rail providing structural support for the bottom end of the elongated cover.

10. A temporary window covering as recited in claim 9, wherein the elongated cover comprises a pleated cover formed from a sheet of material having a plurality of horizontal creases extending across the width of the sheet thereby defining a plurality of pleats, the pleated cover being adapted to be oriented in the retracted position wherein each of the pleats is substantially horizontally aligned and in contact with the adjacent pleats, the extended position wherein each of the pleats is substantially vertical and substantially vertically aligned with the other pleats, and a plurality of intermediate positions wherein at least some of the pleats are oriented between the pleats' retracted positions and the pleats' extended positions, and wherein the top rail is attached to a topmost pleat of the pleated cover and one of the sides of the bottom rail is attached to a bottommost pleat of the pleated cover.

11. A temporary window covering as recited in claim 9, wherein the bottom rail has a first hole and a second hole therethrough, and wherein the cord is threaded through the first hole and the second hole such that the bottom rail and an accumulated portion of the elongated cover are supported by the cord when a portion of the free end of the cord extending through the second hole is disposed in the at least a portion of the slot.

12. A temporary window covering as recited in claim 9, wherein the bottom rail has a first hole therethrough, wherein the slot has an opening having a width greater than the thickness of the cord such that the cord may pass through the opening of the slot, and wherein the cord is threaded through the first hole and the opening of the slot such that the bottom rail and an accumulated portion of the pleated cover are supported by the cord when a portion of the free end of the cord extending through the opening of the slot is disposed into the at least a portion of the slot having the width less than the thickness of the cord.

13. A temporary window covering as recited in claim 12, wherein the slot has a first narrow portion having a width less than the thickness of the cord and a second narrow portion having a width less than the thickness of the cord, wherein the first and second narrow portions are disposed on opposite sides of the opening of the slot.

14. A temporary window covering according to claim 9, wherein the bottom rail has a first notch having a first inner edge and a second notch having a second inner edge, wherein the first inner edge is disposed on the side of the first notch proximate the second notch and the second inner edge is disposed on the side of the second notch proximate the first notch, the first and second inner edges configured to have a portion of a free end of the cord extending beyond the slot wrapped around the first and the second inner edges of the first and second notches, respectively.

15. A temporary window covering according to claim 14, wherein the first inner edge is angled inwardly toward the second notch and the second inner edge is angled inwardly toward the first notch.

16. A temporary window covering, comprising:

a pleated cover formed from a sheet of material having a plurality of horizontal creases extending across the width of the sheet thereby defining a plurality of pleats, with each pleat having a hole therethrough, the pleated cover being moveable between a retracted position wherein each of the pleats is substantially horizontally aligned and in contact with the adjacent pleats, an extended position wherein each of the pleats is substantially vertical and substantially vertically aligned with the other pleats, and a plurality of intermediate positions wherein at least some of the pleats are oriented between the pleats' retracted positions and the pleats' extended positions;

a top rail attached to a topmost pleat of the pleated cover;

a cord having a first end connected to the top rail, with the cord being threaded through the holes of the pleats of the pleated cover; and a bottom rail formed from a plurality of interconnected sides each having a width approximately equal to the width of the sheet and with one of the sides being attached to a bottommost pleat of the pleated cover, wherein the bottom rail has a slot disposed through a surface of the bottom rail, the slot being adapted to receive the cord, and at least a portion of the slot having a width less than the thickness of the cord such that the slot engages the cord to support the weight of the bottom rail and an accumulated portion of the pleated cover when the cord is engaged by the at least a portion of the slot, wherein the sides of the bottom rail are moveable between a packaging configuration wherein the sides of the bottom rail enclose and engage the pleated cover, with the engagement of the sides of the bottom rail preventing the pleated cover from being extended to the extended position, and a support configuration wherein the sides of the bottom rail do not encircle the pleated cover such that the pleated cover may be extend to the extended position and to intermediate positions with the sides of the bottom rail providing structural support for the bottom end of the pleated cover.

17. A temporary window covering as recited in claim 16, wherein the bottom rail has a first hole and a second hole therethrough, and wherein the cord is threaded through the first hole and the second hole such that the bottom rail and an accumulated portion of the pleated cover are supported by the cord when a portion of the free end of the cord extending through the second hole is disposed in the at least a portion of the slot.

18. A temporary window covering as recited in claim 16, wherein the bottom rail has a first hole therethrough, wherein the slot has an opening having a width greater than the thickness of the cord such that the cord may pass through the opening of the slot, and wherein the cord is threaded through the first hole and the opening of the slot such that the bottom rail and an accumulated portion of the pleated cover are supported by the cord when a portion of the free end of the cord extending through the opening of the slot is disposed into the at least a portion of the slot having the width less than the thickness of the cord.

19. A temporary window covering as recited in claim 18, wherein the slot has a first narrow portion having a width less than the thickness of the cord and a second narrow portion having a width less than the thickness of the cord, wherein the first and second narrow portions are disposed on opposite sides of the opening of the slot.

20. A temporary window covering according to claim 16, wherein the bottom rail has a first notch having a first inner edge and a second notch having a second inner edge, wherein the first inner edge is disposed on the side of the first notch proximate the second notch and the second inner edge is disposed on the side of the second notch proximate the first notch, the first and second inner edges configured to have a portion of a free end of the cord extending beyond the slot wrapped around the first and the second inner edges of the first and second notches, respectively.

21. A temporary window covering according to claim 20, wherein the first inner edge is angled inwardly toward the second notch and the second inner edge is angled inwardly toward the first notch.

* * * * *